US006794813B2

(12) United States Patent
Ono et al.

(10) Patent No.: US 6,794,813 B2
(45) Date of Patent: Sep. 21, 2004

(54) ELECTRON SOURCE, IMAGE FORMING APPARATUS, AND MANUFACTURE METHOD FOR ELECTRON SOURCE

(75) Inventors: Takeo Ono, Kanagawa-Ken (JP); Toru Sugeno, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/443,106

(22) Filed: May 22, 2003

(65) Prior Publication Data

US 2003/0197463 A1 Oct. 23, 2003

Related U.S. Application Data

(62) Division of application No. 09/511,388, filed on Feb. 23, 2000, now Pat. No. 6,614,167.

(30) Foreign Application Priority Data

Feb. 25, 1999 (JP) ..... 11-048892
Mar. 5, 1999 (JP) ..... 11-058459
Feb. 2, 2000 (JP) ..... 2000-025582

(51) Int. Cl.[7] ..... H01J 19/24; H01J 29/92
(52) U.S. Cl. ..... 313/495; 313/496; 313/313
(58) Field of Search ..... 313/495, 496, 313/497, 309, 500, 310–311, 313, 292, 422, 306–308; 315/169.1, 169.3; 445/24

(56) References Cited

U.S. PATENT DOCUMENTS 5,066,883 A 11/1991 Yoshioka et al. ..... 313/309
5,591,061 A 1/1997 Ikeda et al. ..... 445/3
5,637,951 A 6/1997 Parker ..... 313/309

(List continued on next page.)

FOREIGN PATENT DOCUMENTS

EP 0 701 265 A1 3/1996
EP 0 865 069 A2 9/1998
JP 64-31332 2/1989

(List continued on next page.)

OTHER PUBLICATIONS

C.A. Spindt et al., *Physical Properties of Thin–film Field Emission Cathodes with Molybd num Cones*, J. Applied Physics, vol. 47, No. 12, Dec. 1976, pp. 5248–5263.
C.A. Mead, *Operation of Tunnel–Emission Devices*, J. Applied Physics, vol. 32, No. 4, Apr. 1961, pp. 646–652.
W.P. Dyke et al., *Field Emission*, Advances in Electronics and Electron Physics, 1956, pp. 89–185.
M. Elinson et al., *The Emission of Hot Electrons and the Field Emissions of Electrons From Tin Oxide*, Radio Engineering and Electronic Physics, Jul. 1965, pp. 1290–1296.

(List continued on next page.)

*Primary Examiner*—Nimeshkumar D. Patel
*Assistant Examiner*—Karabi Guharay
(74) *Attorney, Agent, or Firm*—Fitzpatrick, Cella, Harper & Scinto

(57) ABSTRACT

Uniformity of the electron emission characteristics of electron emitting devices is improved. A substrate is formed with row-directional wires and column-directional wires electrically connected to electron emitting devices disposed in a matrix shape and each having electrodes and an electroconductive film. A pseudo row-directional wire is formed at a position X0 between a position X1 of a row-directional wire and a periphery of the substrate, and a pseudo column-directional wire is formed at a position Y0 between a position Y1 of a column-directional wire and a periphery of the substrate. Pseudo electrodes and are electrically connected to the pseudo row-directional wire and pseudo column-directional wire.

6 Claims, 21 Drawing Sheets

U.S. PATENT DOCUMENTS

| | | | | |
|---|---|---|---|---|
| 5,654,607 | A | 8/1997 | Yamaguchi et al. | 313/495 |
| 5,659,329 | A | 8/1997 | Yamanobe et al. | 345/74 |
| 5,839,363 | A | 11/1998 | Yanagisawa et al. | 101/123 |
| 5,942,849 | A | 8/1999 | Cade | 313/495 |
| 6,114,804 | A | 9/2000 | Kawase et al. | 313/495 |
| 6,160,347 | A | 12/2000 | Iwasaki et al. | 313/545 |
| 6,184,619 | B1 | 2/2001 | Yamazaki et al. | 313/292 |
| 6,262,701 | B1 | 7/2001 | Okuda et al. | 345/74 |
| 6,274,972 | B1 | 8/2001 | Mitsutake et al. | 313/292 |
| 6,283,813 | B1 * | 9/2001 | Kaneko et al. | 445/24 |
| 6,283,815 | B1 | 9/2001 | Iwasaki et al. | 445/41 |

FOREIGN PATENT DOCUMENTS

| | | |
|---|---|---|
| JP | 1-283749 | 11/1989 |
| JP | 2-257552 | 10/1990 |
| JP | 6-342636 | 12/1994 |
| JP | 8-34110 | 2/1996 |
| JP | 8-212909 | 8/1996 |
| JP | 9-27285 | 1/1997 |
| JP | 09/027270 | 1/1997 |
| JP | 09-027285 | 1/1997 |
| JP | 9-272270 | 1/1997 |
| JP | 9-82214 | 3/1997 |
| JP | 9-296469 | 11/1997 |
| JP | 2836015 | 10/1998 |
| JP | 10-321167 | 12/1998 |
| JP | 2000-323076 | 11/2000 |

OTHER PUBLICATIONS

G. Dittmer, *Electrical Conduction and Electron Emission of Discontinuous Thin Films*, Thin Solid Films, 9, 1972 pp. 317–328.

M. Hartwell et al., *Strong Electron Emission From Patterned Tin–Indium Oxide Films*, IEDM, 1975, pp. 519–521.

H. Araki, et a;., *Electorforming and Electron Emission of Carbon Thin Films*, Journal of th Vacuum Soc. of Japan, vol. 2–6, No. 1, 1983, pp. 22–29 (with English Abstract on p. 22).

* cited by examiner

ELECTRON SOURCE, IMAGE FORMING APPARATUS, AND MANUFACTURE METHOD FOR ELECTRON SOURCE

This application is a division of application Ser. No. 09/511,388, filed Feb. 23, 2000 now U.S. Pat. No. 6,614, 167.

BACKGROUND OF THE INVENTION

1. Field of the Invention

The present invention relates to an electron source, an image forming apparatus, and a manufacture method for an electron source.

2. Related Background Art

Many types of apparatus are known in which a number of electron emitting devices and wirings connected to the devices are disposed on a substrate to form a plane type electron source and an electron beam is emitted from a desired electron emitting device to display an image. For example, the publication of U.S. Pat. No. 5,942,849 (Neil Alexander Cade) discloses an apparatus in which electron emission from a field emitter chip is controlled by two grid electrodes (wirings) crossing each other at a right angle. In this apparatus, an electron emitting device is disposed at a cross point between the wirings. Another structure is also known in which an electron emitting device is disposed near at the wiring cross point in an area of the substrate where the wiring is not formed. The present applicant has already proposed an apparatus having such a structure. For example, this apparatus is disclosed in the publication of U.S. Pat. No. 5,654,607.

Electron emitting devices are roughly classified into thermal electron emitting devices and cold cathode electron emitting devices. As cold cathode electron emitting devices, a field emission type (hereinafter called an "FE type"), a metal/insulator/metal type (hereinafter called an "MIM type"), surface conduction electron emitting devices and the like are known.

Examples of the FE type are those disclosed in "Field emission" by W. P. Dyke & W. W. Dolan, Advance in Electron Physics, 8, 89 (1956), "Physical Properties of thin-film field emission cathodes with molybdenium cones" by C. A. Spindt, J. Appl. Phys., 47, 5284 (1976) and the like.

Examples of the MIM type are those disclosed in "Operation of Tunnel-Emission Devices" by C. A. Mead, J. Appl. Phys., 32, 646 (1961) and the like.

Examples of the surface conduction type electron emitting device are those disclosed by M. I. Elinson in Recio Electron Phys., 10, 1290 (1965) and the like.

Surface conduction electron emitting devices utilize the phenomenon that electron emission occurs when current is flowed through a thin film having a small area formed on an insulating substrate in parallel to the film plane.

Reports on surface conduction electron emitting devices show those using $SnO_2$ thin films by Elinson or the like, those using Au thin films ("Thin Solid Films" by G. Dittmer, 9, 317 (1972)), those using $In_2O_3/SnO_2$ thin films (by M. Hartwell and C. G. Fonstad in "IEEE Trans. ED Conf., 519 (1975)), those using carbon thin films ("Vacuum" by Hisashi ARAKI, et. al., Vol. 26, No. 1, p. 22 (1983)), and the like.

As a typical example of these surface conduction electron emitting devices, the device structure by M. Hartwell is schematically shown in FIG. 19. On a substrate 401, an electroconductive film 404 having an H-character shaped pattern and made of a sputtered metal oxide thin film is formed. An electron emitting region 405 shown by hatching in FIG. 19 is formed by an operation called an energization forming operation to be described later. A device electrode distance L shown in FIG. 19 is set to 0.5 to 1 mm and W' is set to 0.1 mm.

Generally, prior to electron emission of the surface conduction electron forming device, the electroconductive film 404 is subjected to the operation called an energization forming operation to form the electron emitting region 405. With the energization forming operation, a voltage is applied between opposite ends of the electroconductive film 404 to locally destruct, deform, or decompose the electroconductive film 404 and change the structure thereof to thereby form the electron emitting region 405 having an electrically high resistance. Fissures 1 are partially formed in the electron emitting region 405 of the electroconductive film 404. Electrons are emitted nearly from these fissures.

Since the surface conduction electron emitting device has a simple structure, it has the advantage that a number of devices can be arranged in a large area. Various applications utilizing such characteristics have been studied. For example, applications to a charged beam source, an image forming apparatus such as a display apparatus and the like are known.

One example of an electron source having a number of surface conduction electron emitting devices is an electron source (e.g., publications of JP-A-64-031332, JP-A-1-283749, JP-A-2-257552 and the like) in which a number of rows are disposed (in a lattice type) and both ends (two device electrodes) of each of surface conduction electron emitting devices disposed in parallel are connected by wirings (common wires).

Surface conduction electron emitting devices can be used for a flat apparatus, particularly a display apparatus similar to liquid display apparatus which is of a self light emission type requiring no back light. Such a display apparatus is disclosed in the publication of U.S. Pat. No. 5,066,883 in which an electron source having a number of surface conduction electron emitting devices is combined with a fluorescent member which emits visual light when an electron beam is applied from the electron source.

The present applicant has also disclosed an example of an image displaying apparatus in the publication of JP-A-6-342636 in which an electron source with surface conduction electron emitting devices having a wiring pattern whose outline structure is schematically shown in FIG. 20. In FIG. 20, a plurality of surface conduction electron emitting devices are connected in a matrix shape by upper wirings 73 and lower wirings 72.

FIG. 21A is a plan view showing the structure of a surface conduction electron emitting device, and FIG. 21B is a cross sectional view of the surface conduction electron emitting device taken along line 21B—21B shown in FIG. 21A. The surface conduction electron emitting device has: a pair of electrodes 202 and 203 formed on an insulating substrate 201; an electroconductive thin film 204 made of fine particles and electrically connected to the electrodes 202 and 203; and an electron emitting region 205 formed partially in the electroconductive thin film 204 for emitting electrons. In this surface conduction electron emitting device, a distance between the pair of electrodes 202 and 203 is set to several ten thousand nm to several hundred $\mu$m, and the length of the device electrode is set to several $\mu$m to several hundred $\mu$m by taking into consideration the resistance of the device electrode and the electron emission characteristics. The thickness of the device electrode is set in a range from several thousand nm to several μm in order to retain the electrical connection to the electroconductive film 204. For example, the electrodes 202 and 203 are formed by photolithography techniques. The thickness of the electroconductive film 204 is set properly by taking into consideration the step coverage to the electrodes 202 and 203, the resistance between the device electrodes, the energization forming conditions and the like. The thickness of the electroconductive film 204 is preferably set in a range from several ten nm to several ten thousand nm, or more preferably in a range from 100 nm to 5000 nm. The sheet resistance Rs of the electroconductive film is preferably set to $10^2$ to $10^7$ Ω/□. Rs is given by R=Rs(l/w) where R is a resistance of a thin film having a thickness t, a width w and a length l as measured in the longitudinal direction. If the thickness t and a resistivity ρ are Constance, then Rs=ρ/t.

FIG. 22 is a schematic diagram showing an example of the structure of an image display apparatus using an electron source with a plurality of surface conduction electron forming devices wired in a matrix format, as disclosed in the above-cited publication of JP-A-6-342636. A rear plate 81, an outer frame 82 and a face plate 86 are adhered together at their connection points and sealed by unrepresented adhesive such as low melting point glass frit to thereby constitute an envelope (hermetically sealed container) 88 which retains vacuum of the inside of the image display apparatus. A substrate 71 is fixed to the rear plate 81. On this substrate 71, m×n surface conduction electron emitting devices are arranged (where m and n are positive integers of 2 or larger which are properly determined in accordance with an objective number of display pixels). As shown in FIG. 22, the surface conduction electron emitting devices 74 are wired by m row-directional wires 72 and n column-directional wires 73. For example, these wires 72 and 73 are formed by photolithography techniques. The structure constituted by the substrate 71, a plurality of electron emitting devices 74 such as surface conduction electron emitting devices, row-directional wires 72 and column-directional wires 73 is called a multi electron beam source. Unrepresented interlayer insulating films are formed at least at the cross points between the row-directional and column-directional wires 72 and 73 to retain electrical insulation between both the wires 72 and 73.

A fluorescent film 84 made of fluorescent material is formed on the bottom surface of the face plate 86, the film 84 being divisionally coated with three primary color fluorescent materials (not shown) of red (R), green (G) and blue (B). A black body (not shown) is disposed between the fluorescent materials of the respective colors of the fluorescent film 84. A metal back 85 made of Al or the like is formed on the fluorescent film 84 on the side of the rear plate 81.

Dx1 to Dxm and Dy1 to Dyn are electrical connection terminals of a hermetic seal structure for electrically connecting the image display apparatus and an unrepresented electric circuit. Dx1 to Dxm electrically connect the multi electron beam source to the column-directional wires. Similarly, Dy1 to Dyn electrically connect the multi electron beam source to the row-directional wires.

The inside of the envelope (hermetically sealed container) is maintained vacuum at $1.33\times10^{-4}$ Pa or lower. Therefore, as the display screen of the image display apparatus is made larger, the means for preventing the rear plate 81 and face plate 86 from being deformed or destructed by a pressure difference between the inside and outside of the envelope (hermetically sealed container) is much more required. It is therefore necessary to dispose support members (not shown) called spacers or ribs between the face plate 86 and rear plate 81 in order to be resistance against the atmospheric pressure.

The distance between the substrate 71 formed with the electron emitting devices and the face plate 86 formed with the fluorescent film is usually set to several hundred μm to several mm, and the inside of the envelope (hermetically sealed container) is maintained high vacuum. With the image display apparatus described above, electrons are emitted from each surface conduction electron emitting device by applying a voltage thereto via the external terminals Dx1 to Dxm and Dy1 to Dyn and via the row- and column-directional wires 72 and 73.

At the same time when the voltage is applied, a high voltage of several hundred V to several kV is applied to the metal back 85 via the external terminal. Electrons emitted from the surface conduction electron emitting device is therefore accelerated and collided with each color fluorescent member formed on the inner surface of the face plate 86. The fluorescent member is therefore excited so that light is emitted and an image is displayed.

In order to manufacture the image display apparatus described above, it is necessary to dispose a number of electron emitting devices and row- and column-directional wires.

As techniques used for forming a number of electron emitting devices and row- and column-directional wires, photolithography techniques, etching techniques and the like are used.

However, if an image display apparatus having a large screen, e.g., several ten inches and using surface conduction electron emitting devices is formed by using photolithography techniques and etching techniques, it is necessary to use large scale manufacture facilities such as a vacuum deposition system, a spin coater, an exposure system, an etching system and the like suitable for a large substrate having a diagonal distance of several ten inches. This poses the problems of control hardness of manufacture processes and high cost.

Printing techniques are known which can form a number of electron emitting devices and row- and column-directional wires of an image display apparatus of a large screen area, as disclosed in the publication of JP-A-9-293469 by the present applicant.

The present applicant disclosed the techniques of forming a number of row- and column-directional wires by using screen printing techniques in JP-A-8-34110.

Screen printing is suitable for forming a thick wiring layer through which large current can be flowed to some degree. By using as a mask an impression formed with openings having a predetermined pattern, print paste mixed with, e.g., metal particles is transferred through the openings to a substrate to be printed, and thereafter the substrate is baked to form electroconductive wires having a desired pattern.

Screen printing will be described with reference to FIG. 23 which is a perspective view of a screen mesh 42 of a screen printing machine and a substrate 100 and with reference to FIG. 24 which is a cross sectional view of the screen mesh 42 and substrate 100 shown in FIG. 23.

In order to make it easy to explain the printing state, an impression frame 41 and screen mesh 42 are shown partially broken in FIG. 23.

First, the outline of screen printing will be described.

As shown in FIG. 23, the screen mesh 42 is suspended by an impression frame 41 by a properly set tensile force. The screen mesh 42 is made of a mesh plate made of stainless steel or the like and a resin film formed thereon. An impression pattern 45 is cut through the resin film to eject print paste 47 via this cut pattern. The print paste 47 to be printed on a substrate 100 is developed on the screen mesh 42 with the impression pattern 45. As the screen mesh 42 is scanned while it is pushed by a squeegee 43, a print pattern 46 is printed on the substrate 100.

Next, the process of screen printing will be described.

First, the surface of the screen mesh 42 suspended by the impression frame 41 and the substrate 100 are set so as to have a predetermined gap 48. Next, the squeegee 43 is lowered until the screen mesh 42 becomes in contact with the substrate 100 at a pushing point 44. Next, the print paste 47 is developed in front of the squeegee 43. While the squeegee 43 is maintained lowered so as to always make the screen mesh 42 in contact with the substrate 100, the squeegee 43 is scanned in a direction indicated by an arrow E in FIG. 23 to scrape off the print paste 47. At this time, by the pressure supplied from the squeegee 43, the print paste 47 is transferred to the substrate 100 via the impression pattern 45. At the same time, the screen mesh 42 is separated from the substrate 100 by a recovery force generated by the vertical components of the tensile force 44 at the pushing point of the screen mesh. The print paste 47 is therefore separated from the screen mesh 42 and a desired print pattern 46 shown in FIG. 23 is formed on the substrate 100.

In the electron source having wiring groups (hereinafter called "row-directional wires" and "column-directional wires") crossing at a right angle each having a plurality of wires and a plurality of electron emitting devices connected to the wires, although the substrate surface excepting the peripheral surface is finely divided by the row- and column-directional wires, at least ones of the row- and column-directional wires are not disposed on the peripheral surface. For example, in an electron source shown in FIG. 25 which has three row-directional wires and three column-directional wires for supplying a power to nine electron emitting devices disposed in a 3×3 matrix shape on a substrate 402, an exposed area other than the wires is relatively broad and charged regions having a large charge amount in the surface area are likely to be formed as shown. In the case such as shown in FIG. 25 wherein the electron emitting device is formed not at the cross point of the wires but in the surface layer of the substrate 402, the row-directional wire is not formed between the peripheral surface of the substrate 402 and ones of outer side devices 401 in the row direction. There is, therefore, a danger that these outer side devices 401 are greatly influenced by the charged areas having an increased charge amount on the surface of the substrate 402. The same danger occurs for the outer side devices in the column direction.

The problem of an increased charge amount of the substrate surface near the device may be associated with the following disadvantages.

(1) The charge amount of the substrate surface near the electron emitting devices belonging to the row without the outer side row-directional wire and to the column without the outer side column-directional wire is larger than that of other electron emitting devices. Therefore, the distribution of an electric field near each device becomes different. The electron emission characteristics are therefore different therebetween and uniformity of the electron emission characteristics is degraded.

(2) Since the distribution of the electric field near each device becomes different, the trajectory of an emitted electron also becomes different. Therefore, the effective uniformity of the electron source is further degraded.

(3) The charge amount of the substrate surface also changes with the device drive conditions (drive voltage, drive pulse width and the like). This becomes more conspicuous to the electron emitting device without the outer side row or column wire than other devices. A change in the characteristics caused by (1) and (2) varies greatly with time, and the fluctuation of the characteristics is especially great in the device without the outer side row or column wire than other devices.

(4) A large charge amount may cause discharge between the charged area of the substrate surface and the device, wires and the like. This discharge may damage the electron emitting device, so that the electron emission amount may reduce or the device may be destroyed.

The following problem may occur when a plurality of parallel wires are formed by the screen printing method described above. As described earlier, screen printing is executed by pushing the mesh screen against the substrate. When the screen mesh separates from the substrate after print paste is transferred to the substrate via the pattern of the screen mesh, two forces are exerted on the pushing point of the screen mesh. One force results from the tensile force of the screen mesh to separate the screen mesh from the substrate, and the other force is applied from the print paste transferred to the substrate to adhere the screen mesh to the substrate. While one wiring pattern is printed, other wiring patterns on both sides of the one wiring pattern are also formed. The screen mesh separates from the substrate while being influenced by the adhesion force of each wiring pattern. Therefore, of a number of parallel wiring patterns, the pattern near the central area and the pattern in the outer side area receive different adhesion forces. The wiring pattern, particularly the outermost wiring pattern does not receive the adhesion force at the area outer than this pattern, so that the transfer of print paste becomes likely to be irregular. The shape defect of the print pattern may occur, possibly resulting in contact defects between wires and device electrodes, wire resistance distribution, high resistance in the peripheral area, wire disconnection, and the like.

SUMMARY OF THE INVENTION

It is an object of the invention to provide an electron source and an image forming apparatus having good characteristics, and a manufacture method for such an electron source. Specific embodiments of the invention can solve at least one of the problems specifically described above.

The present invention provides an electron source having a plurality of first wires and a plurality of electron emitting devices respectively formed on a substrate, the first wires having a longitudinal direction generally along a first direction and the electron emitting devices being connected to each of the first wires, comprising: at least one first conductor formed between first outer electron emitting devices among the plurality of electron emitting devices and an outer periphery of the substrate, and near the first outer electron emitting devices, the first wire not being formed between the outer periphery and the first outer electron emitting devices, the first conductor having a side on a side of the first outer electron emitting devices, the side extending generally along the first direction, wherein the conductor is not connected to electron emitting devices connected directory in a wire to which at least some of the plurality of electron emitting devices are connected.

With this structure, the first conductor can suppress electric charges and/or can mitigate the adverse effects of electric charges.

The invention is particularly effective if each electron emitting device is formed at a position different from a position where each first wire is formed.

The electron source may further comprise at least one second wire formed on the substrate, the second wire having a longitudinal direction generally along a second direction crossing the first direction, each electron emitting device is connected to one of the first wires and the second wire. The invention is effectively applicable to the structure wherein the electron emitting device is formed in an area different from the areas where the first and second wires are formed.

If the second wire is used and there is an electron emitting device connected to the first conductor and second wire, undesired charge transfer may occur by a potential difference between the first conductor and second wire. It is therefore preferable not to connect the electron emitting devices connected to the second wire, to the first conductor.

The electron source may further comprise a plurality of second wires formed on the substrate, the second wires having a longitudinal direction generally along a second direction crossing the first direction, wherein each electron emitting device is formed at a cross point between each of the first wires and each of the second wires and connected to the first wire and the second wire crossing at the cross point.

The electron source may further comprise at least one second conductor formed between second outer electron emitting devices among the plurality of electron emitting devices and an outer periphery of the substrate at least on one side of the substrate, and near the second outer electron emitting devices, the second wire not being formed between the outer periphery and the second outer electron emitting devices, the second conductor having a side on a side of the second outer electron emitting devices, the side extending generally along the second direction. It is also preferable not to connect the electron emitting devices to be driven to the second conductor. It is preferable that the electron emitting devices connected to the second wire are not connected to the first conductor and the electron emitting devices connected to the first wire are not connected to the second conductor.

It is preferable that the second conductor is electrically connected at least any of the wires, and more preferably, the second conductor is electrically connected to the second wire.

The electron source may further comprise: a plurality of second wires formed on the substrate, the second wires having a longitudinal direction generally along a second direction crossing the first direction, wherein each electron emitting device is formed at a cross point between each of the first wires and each of the second wires and connected to the first wire and the second wire crossing at the cross point; and at least one second conductor formed between second outer electron emitting devices among the plurality of electron emitting devices and an outer periphery of the substrate at least on one side of the substrate, and near the second outer electron emitting devices, the second wire not being formed between the outer periphery and the second outer electron emitting devices, the second conductor having a side on a side of the second outer electron emitting devices, the side extending generally along the second direction, wherein the second conductor is electrically connected to the second wire excepting the second wire nearest to the second conductor.

Electric charges can effectively suppressed if a distance between the second conductor and the second wire nearest to the second conductor is set to a twofold of or smaller than a distance between the adjacent second wires. More preferably, a distance between the second conductor and the second wire nearest to the second conductor is set generally equal to a distance between the adjacent second wires. The generally equal distance means that a difference between distances is 20% or smaller than the distances. The distance means a gap between the sides of adjacent wires in the longitudinal direction. If the distance is not constant, the average value is used.

It is preferable that a plurality of second conductors are formed adjacent to each other at a distance shorter than a distance of the adjacent second wires.

It is preferable that a resistance value of the second conductor is set to a tenfold of or smaller than a resistance value of the second wire. More preferably, the resistance value of the second conductor is set generally equal to that of the second wire.

The invention is particularly effective if the second wire is applied with a signal for driving the electron emitting device.

It is preferable that the first conductor is electrically connected to the first wire. This structure is particularly effective. It is preferable that the first conductor is electrically connected to the first wire excepting the second wire nearest to the first conductor.

It is also preferable that a plurality of first conductors are formed adjacent to each other at a distance shorter than a distance between the adjacent first wires.

It is preferable that a distance between the first conductor and the first wire nearest to the first conductor is set to a twofold of or smaller than a distance between the adjacent first wires. More preferably, a distance between the first conductor and the first wire nearest to the first conductor is set generally equal to a distance between the adjacent first wires.

It is preferable that a resistance value of the first conductor is set to a tenfold of or smaller than a resistance value of the first wire. More preferably, a resistance value of the first conductor is set generally equal to that of the first wire.

It is preferable that the first wire is applied with a signal for driving the electron emitting device. For example, a selection signal is sequentially applied to the plurality of first wires to scan the electron emitting devices. A modulation signal may be applied to the first wires. More specifically, a selection signal is sequentially applied to the plurality of first wires to scan the electron emitting devices and a modulating signal is applied to the second wires to properly scan the electron source.

The present invention covers following structures of the electron sources, which can be used in combinations of the above described structures.

The invention also provides an electron source having a plurality of first wires, a plurality of second wires, and a plurality of electron emitting devices respectively formed on a substrate, the first wires having a longitudinal direction generally along a first direction, the second wires having a longitudinal direction generally along a second direction crossing the first direction, and the electron emitting device being connected each of the first wires and each of the second wires at a cross point therebetween, comprising: at least one first conductor formed between first outer electron emitting devices among the plurality of electron emitting devices and an outer periphery of the substrate, and near the first outer electron emitting devices, the first wire not being formed between the outer periphery and the first outer electron emitting devices, the first conductor having a side on a side of the first outer electron emitting devices, the side extending generally along the first direction; and at least one second conductor formed between second outer electron emitting devices among the plurality of electron emitting devices and an outer periphery of the substrate, and near the second outer electron emitting devices, the second wire not being formed between the outer periphery and the second outer electron emitting devices, the second conductor having a side on a side of the second outer electron emitting devices, the side extending generally along the second direction.

The scope of the present invention covers also following structures. The following structures belongs to the scope of the above described structure, but can be desirably used in combination of the above described structure.

The invention also provides an electron source having a plurality of first wires and a plurality of electron emitting devices respectively formed on a substrate, the first wires having a longitudinal direction generally along a first direction and the electron emitting devices being connected to each of the first wires, comprising: a plurality of first conductors formed between outer electron emitting devices among the plurality of electron emitting devices and an outer periphery of the substrate, and near the outer electron emitting devices, the first wires not being formed between the outer periphery and the outer electron emitting devices, the first conductors having a side on a side of the first outer electron emitting devices, the side extending generally along the first direction.

The invention also provides an electron source having a plurality of first wires and a plurality of electron emitting devices respectively formed on a substrate, the first wires having a longitudinal direction generally along a first direction and the electron emitting devices being connected to each of the first wires, comprising: at least one first conductor formed between outer electron emitting devices among the plurality of electron emitting devices and an outer periphery of the substrate, and near the outer electron emitting devices, the first wire not being formed between the outer periphery and the outer electron emitting devices, the first conductor having a side on a side of the outer electron emitting devices, the side extending generally along the first direction, wherein the first conductor is electrically connected to the first wire.

The invention also provides an image forming apparatus comprising: the electron source described above; and a fluorescent member for emitting light upon application of electrons emitted from the electron source.

The invention also provides a method of manufacturing an electron source having a plurality of wires and a plurality of electron emitting devices connected to the wires, comprising the step of: forming a wiring pattern, and a conductor pattern similar to the wiring pattern in an area different from an area where the wiring pattern is formed, by a screen printing method.

DETAILED DESCRIPTION OF THE PREFERRED EMBODIMENTS

Next, embodiments of the invention will be described with reference to the accompanying drawings.

Figure 1:
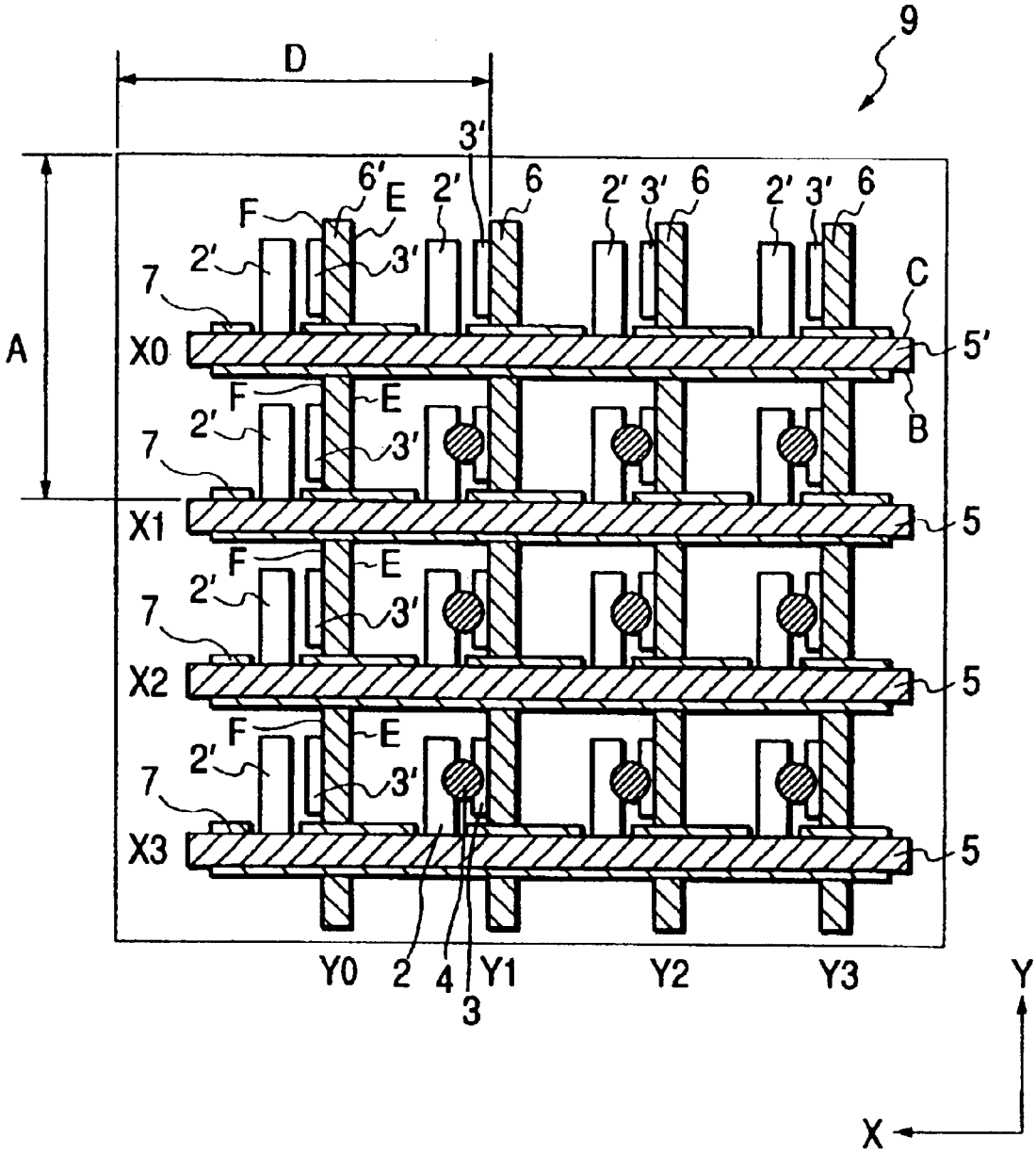
FIG. 1 is a schematic plan view showing an example of an electron source of the invention.

FIG. 1 is a schematic plan view showing an example of the structure of an electron source of the invention. For simplicity, the electron source having nine electron emitting devices disposed in a 3×3 matrix shape is shown. However, a practical electron source has a number of electron emitting devices.

A substrate 1 of an electron source 9 is formed with: row-directional wires 5 represented by X1 to X3 for driving electron emitting devices and a pseudo row-directional wire 5' represented by X0 for not driving electron emitting devices, respectively in the X direction; and column-directional wires 6 represented by Y1 to Y3 for driving electron emitting devices and a pseudo column-directional wire 6' represented by Y0 for not driving electron emitting devices, respectively in the Y direction. Interlayer insulating films 7 are formed between the row-directional wires 5 and pseudo row-directional wire 5' and the column-directional wires 6 and pseudo column-directional wire 6' in order to electrically insulate the row-directional wires 5 and pseudo row-directional wire 5' from the column-directional wires 6 and pseudo column-directional wire 6'.

More specifically, the pseudo row-directional wire 5' is formed in an area (area A in FIG. 1) between the electron emitting devices having no row-directional wire 5 on the side of the upper periphery of the substrate 1, and in an area near the electron emitting devices connected to the X1 row-directional wire 5 not in an area near the upper periphery. The side B of the pseudo row-directional wire 5' on the side of the electron emitting devices connected to the X1 row-directional wire 5 (not the side C of the pseudo row-directional wire 5' on the side of the upper periphery) is made in parallel to the longitudinal direction of the row-directional wire 5. As will be later described, an electroconductive film 4 functioning as the electron emitting device is not connected between pseudo electrodes 2' and 3'. The side C of the pseudo row-directional wire 5' may also be made in parallel to the longitudinal direction of the row-directional wire 5.

Similarly, the pseudo column-directional wire 6' is formed in an area (area D in FIG. 1) between the electron emitting devices having no column-directional wire 6 on the side of the upper periphery of the substrate 1, and in an area near the electron emitting devices connected to the Y1 column-directional wire 6 not in an area near the upper periphery. The side E of the pseudo column-directional wire 6' on the side of the electron emitting devices connected to the Y1 column-directional wire 6 (not the side F of the pseudo column-directional wire 6' on the side of the upper periphery) is made in parallel to the longitudinal direction of the column-directional wire 6. As will be later described, an electroconductive film 4 functioning as the electron emitting device is not connected between pseudo electrodes 2' and 3'. The side F of the pseudo column-directional wire 6' may also be made in parallel to the longitudinal direction of the column-directional wire 6.

The shape of the pseudo row-directional wire 5' is preferably similar to that of the row-directional wire 5, in order to make the electric field near the electron emitting devices similar to that near other electron emitting devices as will be later described. From the same reason, the shape of the pseudo column-directional wire 6' is preferably similar to that of the column-directional wire 6.

A surface conduction electron emitting device is constituted of: an electroconductive film 4 for emitting electrons, the film being made of deposition having carbon as its main component, covered with a cover film, and formed with fissures; an electrode 2 for connecting the electroconductive film 4 to the row-directional wire 5; and an electrode 3 for connecting the electroconductive film 4 to the column-directional wire 6. The electrodes 2 and 3 are formed in order to provide good ohmic contacts between the conductive film 4 and the row- and column-directional wires 5 and 6. Since the electroconductive film 4 is very thin as compared with a wiring electroconductive layer, it is formed in order to avoid the problems such as "wettability" and "step coverage". Each electron emitting device is formed in an area not superposed by the row- and column-directional wires 5 and 6.

Although the surface conduction electron emitting device is used as an example of an electron emitting device, the device is not limited only thereto, but any type of devices may also be used.

A pseudo electrode 2' corresponding to the electrode 2 is connected to the pseudo row-directional wire 5' formed on the side of the outer periphery of the substrate 1. Similarly, a pseudo electrode 31 corresponding to the electrode 3 is connected to the pseudo column-directional wire 6' formed on the side of the outer periphery of the substrate 1. The conductive film 4 is not connected to these pseudo electrodes 2' and 3'. The pseudo electrodes 2' and 3' are provided in order to make the electric fields of the electron emitting devices connected to the X1 row-directional wire 5 and Y1 column-directional wire 6 have similar electric fields of the other electron emitting devices. However, the pseudo electrodes are not necessarily required, and the advantages of the invention can be obtained without these pseudo electrodes.

It is preferable not to form an electron-emitting device for the pseudo electrodes 2' and 3' similar to other electrodes. The reason for this is as follows. As the potential is applied to the row- and column-directional wires 5 and 6 in order to drive the electron source 9, a potential difference is generated between some of the row-wires 5 or column-directional wires 6 and the pseudo row-directional wire 5' or pseudo column-directional wire 6', and some current may flow. Therefore, unnecessary power is consumed. If discharge occurs in the peripheral area of the substrate 1 and the electron emitting devices are connected to the pseudo row-directional wire 5' or pseudo column-directional wire 6', charges may flow into the row- and column-directional wires 5 and 6 from the electron emitting devices connected to the pseudo row-directional wire 5' or pseudo column-directional wire 6'. In this case, the electron emitting devices used essentially for the electron source 9 may be damaged. However, if the electron emitting devices are not connected to the pseudo row-directional wire 5' or pseudo column-directional wire 6', the charges flow into the external via the pseudo row-directional wire 5' or pseudo column-directional wire 6', and damages of the electron source 9 can be avoided. In order to avoid such problems, devices are preferably not connected to the pseudo wires. As apparent from the above reason, electron emitting devices may be formed for the pseudo wires 5' and 6' if they are not connected to the pseudo wires 5' and 6'.

The pseudo row-directional wire 5' and pseudo column-directional wire 6' not connecting electron emitting devices function to suppress print pattern defects of each wiring pattern formed by a screen printing method to be later described, the defects otherwise being formed by the absence of wires on the outer side. In addition, as will be later described, the electric field near the electron emitting device near the outer periphery of the substrate can be made similar to that near other devices, and damages of the electron source 9 to be caused by unexpected discharges or the like can be prevented.

The electrical resistance of the pseudo row-directional wire 5' and pseudo column-directional wire 6' is preferably a tenfold of or smaller than that of the row- and column-directional wires 5 and 6.

The pseudo row-directional wire 5' may be connected to the row-directional wire 5, and the pseudo column-directional wire 6' may be connected to the column-directional wire 6. In this case, it is preferable that the pseudo row-directional wire 5' and pseudo column-directional wire 6' are connected to the row- and column-directional wires 5 and 6 different from the row- and column-directional wires 5 and 6 nearest to the pseudo row-directional wire 5' and pseudo column-directional wire 6'. Such connection between the pseudo wires and other wires is preferable if the pseudo wires are electrically connected to the wires to which applied is a selection voltage for selecting one of a plurality of row wires and one of a plurality of column wires to which a signal is applied. In an embodiment to be later described, the pseudo row-directional wire 5' is connected to the row-directional wire 5 to which a row selection voltage is applied so as to connect the pseudo wire to the wire different from the wire nearest to the pseudo wire. It is needless to say that such electrical connection may be realized if a column selection voltage is applied to the column-directional wire.

The pseudo row-directional wire 5' and column-directional wire 6' each are not limited to only one wire as shown in FIG. 1, but a plurality of wires may be used. In this case, the distances between the pseudo row-directional wire 5' and column-directional wire 6' among a plurality of row-directional wire 5' and column-directional wire 6' nearest to the row-directional wire 5 and column-directional wire 6 and the row-directional wire 5 and column-directional wire 6 may be the same as the distance between the row-directional wires 5 or a twofold thereof or shorter, or the same as the distance between the column-directional wires 6 or a twofold thereof or shorter. The distances between a plurality of pseudo row-directional wire 5' and between a plurality of pseudo column-directional wires 6' may be shorter than the distances between the row-directional wires 5 and between the column-directional wires 6.

The pseudo row-directional wire 5' is formed outside of the electron emitting devices positioned outside (upper side in FIG. 1) of the outermost X1 row-directional wire 5. Instead, the pseudo row-directional wire 5' may also be formed on the opposite side, i.e., lower than X3. In this case, the effects of the pseudo row-directional wire 5' can be obtained from both sides of the substrate 1. This is also applied to the pseudo column-directional wire 6'.

Next, with reference to FIGS. 2A to 2E, the description is given for an example of manufacture processes for the electron source shown in FIG. 1 which is an illustrative example of the invention. In FIGS. 2A to 2E, the substrate 1 is omitted.

The column-directional wires, pseudo column-directional wire and interlayer insulating films are formed by the manufacture processes shown in FIGS. 2A to 2E for the electron source 9 by using a screen printing method. The manufacture method for the electron source is not limited to the screen printing method, but photolithography techniques may also be used.

Figure 2A:
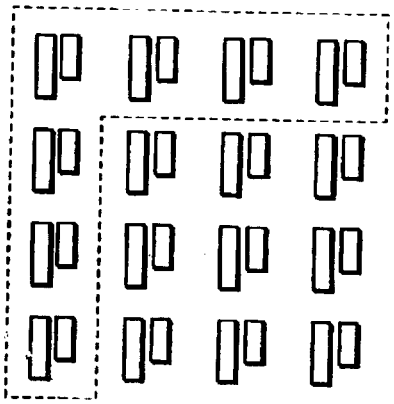
FIGS. 2A, 2B, 2C, 2D and 2E are schematic diagrams illustrating each process of manufacturing the electron source shown in FIG. 1.

First, as shown in FIG. 2A, on a cleaned substrate 1, electrodes 2 and 3 and pseudo electrodes 2' and 3' are formed. In FIG. 2A, electrodes surrounded by a broken line are the pseudo electrodes 2' and 3', and other electrodes are the electrodes 2 and 3 functioning as usual electrodes.

The electrodes 2 and 3 and pseudo electrodes 2' and 3' may be formed by using thin film deposition techniques such as vacuum evaporation, sputtering and CVD, and patterning techniques through photolithography, or by forming patterns of electrode source materials and then thermally processing them to realize desired shapes and materials. As described earlier, although forming the pseudo electrodes 2' and 3' is preferable in some cases, these electrodes are not necessarily required in this embodiment and only the electrodes 2 and 3 may be formed.

Figure 2B:
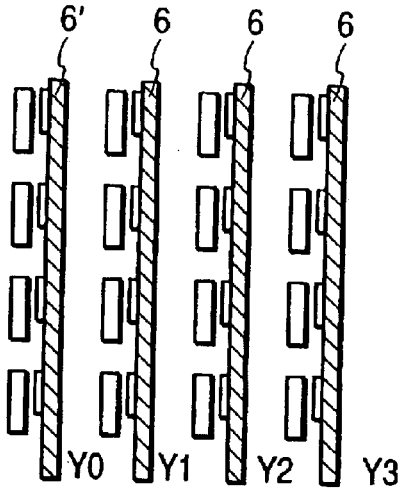

Next, as shown in FIG. 2B, column-directional wires 6 and a pseudo column-directional wire 6' are formed being electrically connected to the electrodes 3 and pseudo electrodes 3'.

An unrepresented column-directional wire screen impression with conductive paste containing Ag or the like is positioned facing the substrate 1 at a predetermined distance. The unrepresented column-directional wire screen impression mounted on an unrepresented impression frame is being formed with column-directional wire patterns and pseudo column-directional wire patterns.

Next, an unrepresented squeegee is pushed against the column-directional wire screen impression and scanned in a predetermined direction to transfer the conductive paste on the column-directional wire screen impression to the substrate 1. The column-directional wires 6 and pseudo column-directional wire 6' transferred to the substrate 1 is dried and thereafter baked.

Figure 2C:
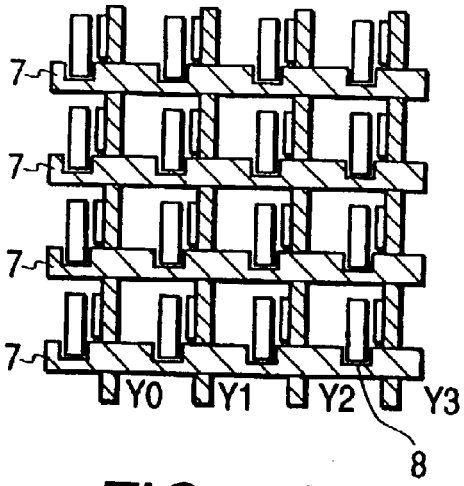

Next, as shown in FIG. 2C, interlayer insulating films 7 are formed. The interlayer insulating film 7 is made of insulating material such as $SiO_2$ and PbO. The film forming method may be a screen printing method similar to that used for the column-directional wire wires 6 and pseudo column-directional wire 6', and in addition, a thin film deposition method such as sputtering, a glass paste printing and thermally processing method, and the like may also be used.

The interlayer insulating films 7 are formed between the column-directional wires 6 and a pseudo column-directional wire 6' and row-directional wires 5 and a pseudo row-directional wire 5' to be described later in order to electrically insulate the column-directional wires 6 and pseudo column-directional wire 6' from the row-directional wires 5 and pseudo row-directional wire 5' at their respective cross points. The interlayer insulating films 7 each have recesses 8 corresponding to the electrodes 2 and pseudo electrodes 2' because the row-directional wires 5 and pseudo row-directional wire 5' are electrically connected to the electrodes 2 and pseudo electrodes 2' as will be later described. In FIG. 2C, although each interlayer film 7 is formed to have a stripe shape, it may be formed discretely at each cross point in order that the row-directional wires 5 and pseudo row-directional wire 5' are electrically connected to the electrodes 2 and pseudo electrodes 2' as described above and that the column-directional wires 6 and pseudo column-directional wire 6' are electrically insulated from the row-directional wires 5 and pseudo row-directional wire 5' at their respective cross points.

Figure 2D:
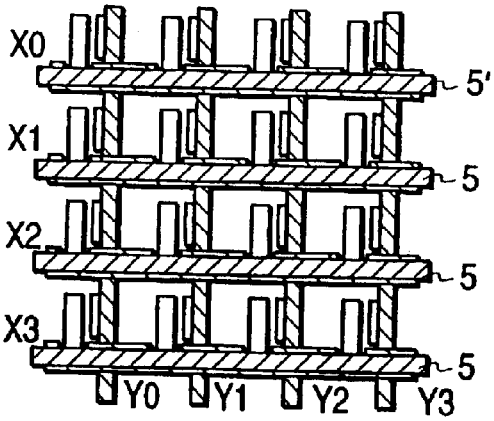

Next, as shown in FIG. 2D, the row-directional wires 5 and pseudo row-directional wire 5' are formed. Although the row-directional wires 5 and pseudo row-directional wire 5' are formed on the interlayer insulating films 7, they are electrically connected to the electrodes 2 and pseudo electrodes 2' via the recesses of the interlayer insulating films 7.

Figure 2E:
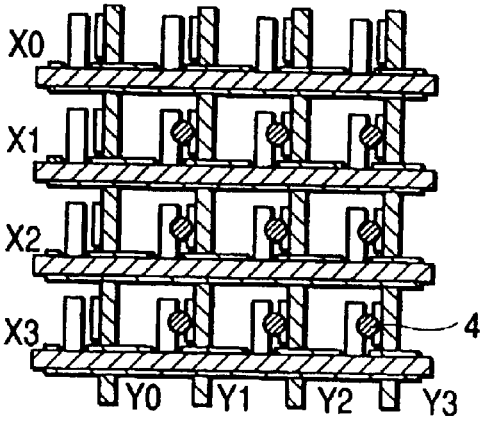
Figure 2E:
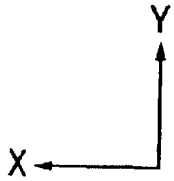

Next, the electroconductive films are formed and an energization forming operation, an activation operation, and a stabilization operation are performed to complete the electron source 9 of this invention as shown in FIG. 2E. These operations are processes characteristic to the surface conduction electron emitting devices. Specific methods for these operations may be those disclosed in U.S. Pat. No. 5,591,061, Japanese Patent No. 2836015, and the like. The invention is applicable to other types of electron emitting devices. In this case, the processes of forming the device are changed depending on each type.

The manufacture method for an electron source of this invention described above forms wires, interlayer insulating films and pseudo wires by the screen printing method. It is obvious that this method is applicable not only to the electron source 9 having wires disposed in a matrix shape, but also to an electron source having wires only in one direction (e.g., in the row direction) with similar advantages.

Next, an image forming apparatus of this invention using the electron source manufactured as above will be described.

Figure 3:
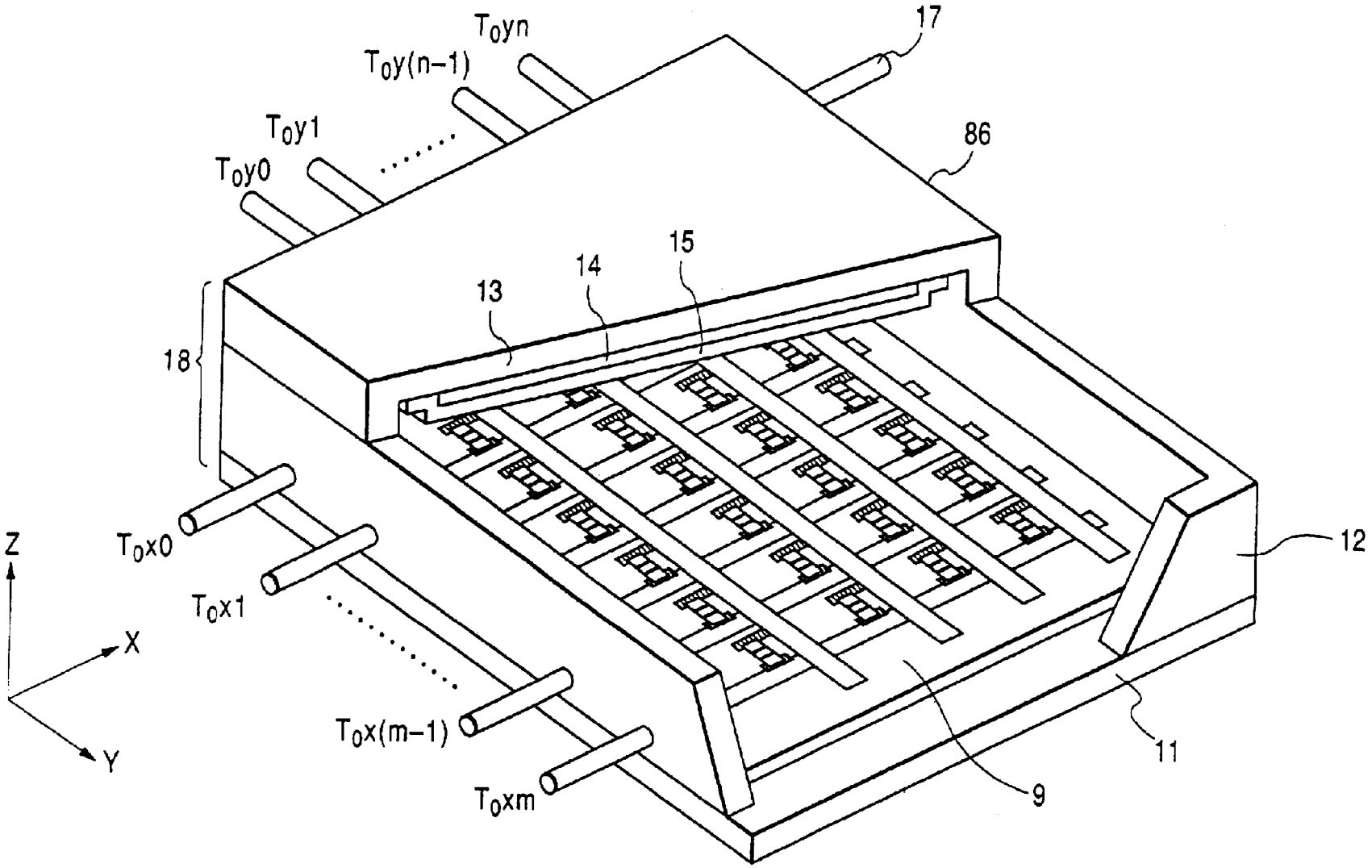
FIG. 3 is a perspective view schematically showing an example of the structure of an image forming apparatus using an electron source of this invention.

FIG. 3 is a perspective view schematically showing an example of the image forming apparatus according to the invention. The apparatus shown in FIG. 3 is partially broken in order to shown the internal structure thereof.

A hermetically sealed container 18 is constituted of a rear plate 11, a support frame 12 and a face plate 16 adhered together at their connection points and sealed by unrepresented adhesive such as low melting point glass frit. The hermetically sealed container 18 houses therein the electron source 9 manufactured as described above. A fluorescent film 14 is formed on the bottom surface of the face plate 16, the film 14 being divisionally coated with three primary color fluorescent materials (not shown) of red (R), green (G) and blue (B). A black body (not shown) is disposed between the fluorescent materials of the respective colors of the fluorescent film 14. A metal back 15 made of Al or the like is formed on the fluorescent film 14 on the side of the rear plate 11.

For a monochrome display, the fluorescent film 14 can be made of only single fluorescent material. For a color display described above, the fluorescent film 14 can be made of color fluorescent materials and black color conductive material called black stripes or black matrix depending on the layout of fluorescent materials. The objective of providing the black stripes or black matrix is to make color mixture and the like not conspicuous by making black between respective fluorescent materials of primary three colors, and to suppress the contrast from being lowered by external light reflection at the fluorescent film. The material of the black stripes may be the generally used material containing as its main component black lead, and in addition the material which is conductive and has less transmission and reflection of light.

The method of coating fluorescent material on the glass substrate may be semidentating, printing or the like irrespective of whether the display is monochrome or color.

The objective of providing the metal back 15 is to improve the brightness by mirror-reflecting light emitted from the fluorescent material to the inner side and directing it toward the face plate 16, to use the metal back 15 as an electrode for applying an electron beam acceleration voltage, and to protect the fluorescent material from being damaged by collision of negative ions generated in the hermetically sealed container 18, and the like. The metal back 15 is formed in the manner that after the fluorescent film is formed, the inner surface of the fluorescent film is planarized (generally called "filming") and thereafter aluminum is deposited by vacuum evaporation or the like.

A transparent electrode (not shown) may be formed on the face plate 16 on the outer surface side of the fluorescent film in order to improve the conductivity of the fluorescent film.

External terminals Tox1 to Toxm and external terminals Toy1 to Toyn are connected to X1 to Xm row-directional wires 5 and Y1 to Yn column-directional wires 6, respectively. An external terminal Tox0 and an external terminal Toy0 are connected to an X0 pseudo row-directional wire 5' and a Y0 pseudo column-directional wire 6, respectively. An external terminal 17 is connected to the metal back 15.

Proper voltages are applied to the external terminal Tox1 to Toxm and the external terminal Toy1 to Toyn to emit electrons from a desired electron emitting device. At this time, a proper potential (e.g, ground potential) is applied to the pseudo row-directional wire 5' and pseudo column-directional wire 6' via the external terminals X0 and Y0, to thereby prevent areas having a large charge amount from being formed near the periphery of the substrate 1. The electric field near the electron emitting devices connected to the X1 row-directional wire 5 and Y1 column-directional wire 6 without row- and column-directional wires on the periphery side of the substrate 1, can be made less different from the electric field near the other electron emitting devices. Therefore, the uniformity of the electron emission characteristics of all electron emitting devices formed on the substrate 1 can be improved.

If the pseudo row-directional wire 5' is connected to one of the row-directional wires 5 or the pseudo column-directional wire 6' is connected to one of the column-directional wires 6, the external terminal Tox0 or Toy0 may be omitted.

A high voltage is applied to the metal back 15 via the external terminal 17 to accelerate electrons emitted from the electron source 9 and make them incident upon the lamination structure made of the metal back 15 and fluorescent film, so that the fluorescent material of the fluorescent film is excited to emit light and form an image.

A method of driving the image forming apparatus is fundamentally similar to the method described in the above-cited publications and the like, excepting that a proper potential is applied to the pseudo row-directional wire 5' and pseudo column-directional wire 6', and so the description of the method is not duplicated herein.

The invention will be further described with reference to embodiments. Reference numerals and symbols used in the following description are identical to those used in the above description of the invention.

[Embodiments]

(First Embodiment)

In this embodiment, processes of forming the electron source 9 by photolithography techniques will be described.

An electron source having 120 electron emitting devices arranged in each of 80 parallel rows was manufactured.

Figure 4:
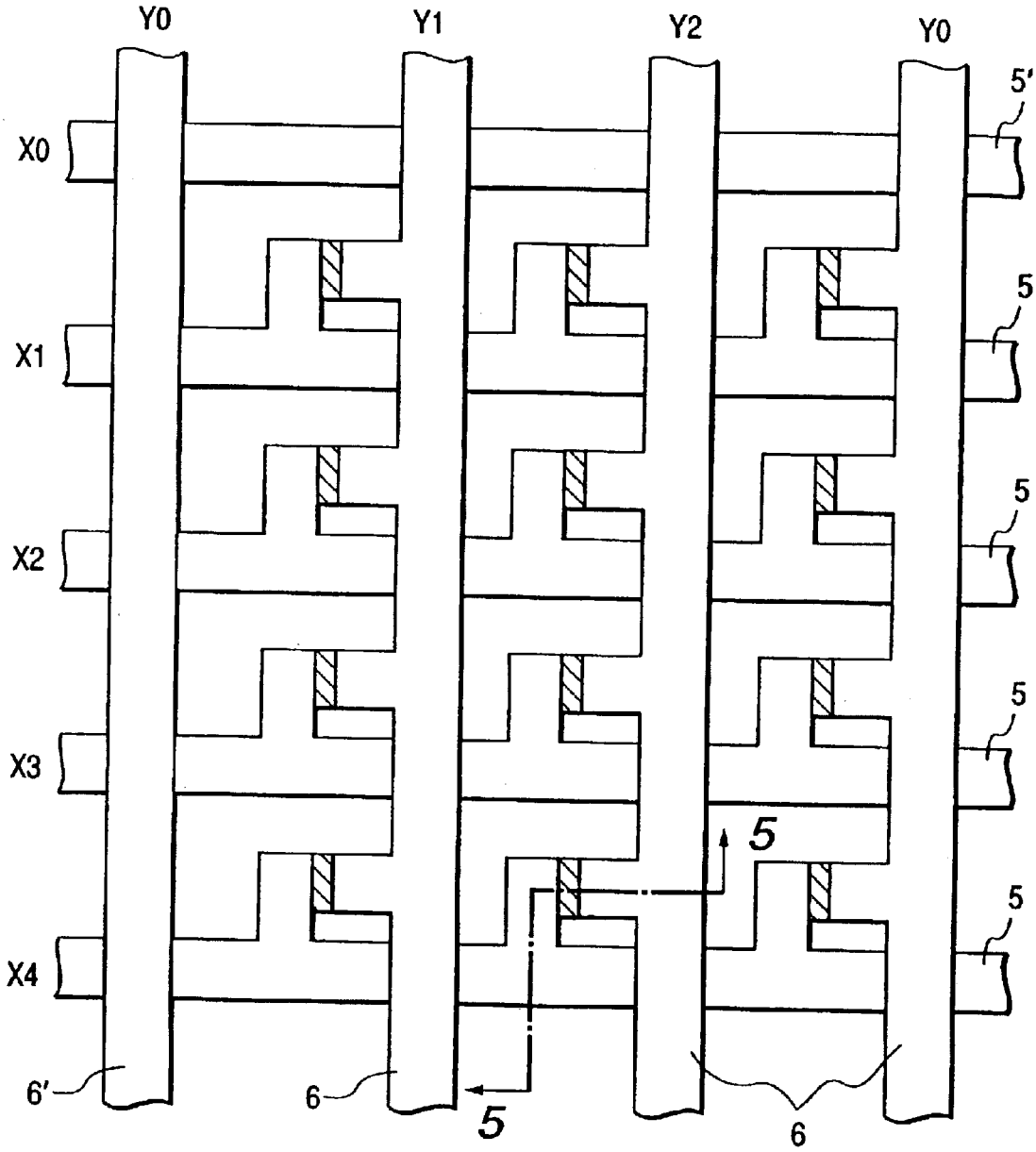
FIG. 4 is a schematic plan view showing the structure of an electron source according to a first embodiment of the invention.
Figure 5:
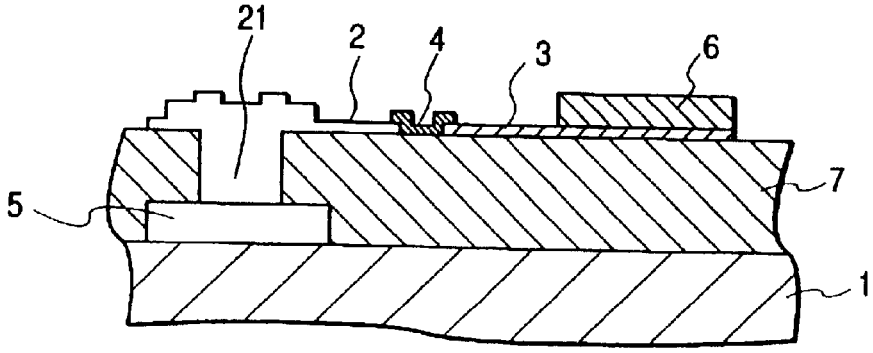
FIG. 5 is a schematic diagram showing the sectional structure of the electron source taken along line 5—5 in FIG. 4.
Figure 6A:
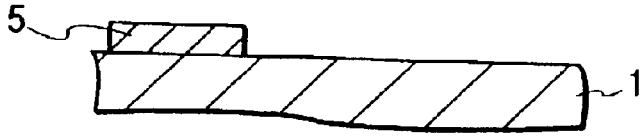
FIGS. 6A, 6B, 6C, 6D, 6E, 6F and 6G are schematic diagrams illustrating each process of manufacturing the electron source according to the first embodiment of the invention.

FIG. 4 is a schematic plan view showing the characteristic layout of electron emitting devices, row-directional wires, column-directional wires, a pseudo row-directional wires and a pseudo column-directional wire. Although the interlayer insulating films described earlier are formed at the cross points between wires and pseudo wires in order to electrically insulate them, they are omitted in FIG. 4 in order to make it easy to understand the layout. FIG. 5 is a schematic diagram taken along line 5—5 in FIG. 4 and showing the cross sectional structure. Although each electron emitting device has a fine structure such as fissures in the electroconductive film, this structure is not shown in FIG. 5. FIGS. 6A to 6G illustrate the manufacture processes of the electron source of this embodiment shown in FIGS. 4 and 5. Similar to FIG. 5, FIGS. 6A to 6G are schematic diagrams showing the cross sectional structure taken along line 5—5 in FIG. 4, Process A On a cleaned soda lime glass, a silicon oxide film was deposited to a thickness of 0.5 μm by sputtering. This soda lime glass was used as a substrate 1. On this substrate 1, Cr and Au were deposited in this order to thicknesses of 5 nm and 600 nm by vacuum evaporation. Thereafter, photoresist (AZ 1370, manufactured by Hoechst Aktiengesellschaft) was coated by using a spinner and baked. Thereafter, desired patterns were exposed and developed to form resist patterns corresponding to the shapes of column-directional wires (lower wires) 5 and a pseudo column-directional wire 5'. Next, the Au/Cr lamination film not covered with the resist pattern was wet etched and removed, and the resist pattern was removed by using solvent. The column-directional wires 5 and pseudo column-directional wire 5' were therefore formed as shown in FIG. 6A.

Process B

Figure 6B:
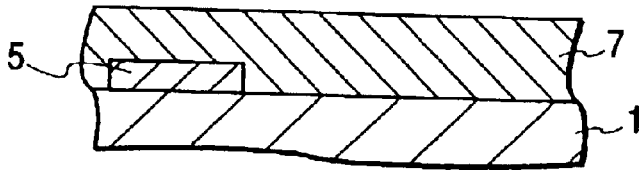

Next, a silicon oxide film was deposited to a thickness of 1.0 μm by RF sputtering to form an interlayer insulating film 7 shown in FIG. 6B. The interlayer insulating film 7 was formed on generally the whole area of the substrate excepting a contact hole 21.

Process C

Figure 6C:
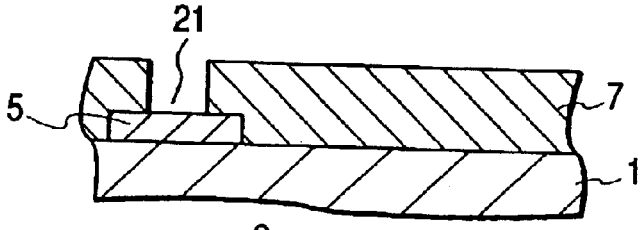

Next, in order to form the contact hole 21 shown in FIG. 6C, a resist pattern having an opening corresponding to the contact hole 21 was formed. By using this resist pattern, the interlayer insulating film 7 was etched to form the contact hole 21.

For this etching, reactive ion etching was executed by using $CF_4$ and $H_2$ as etching gas.

Process D

Figure 6D:
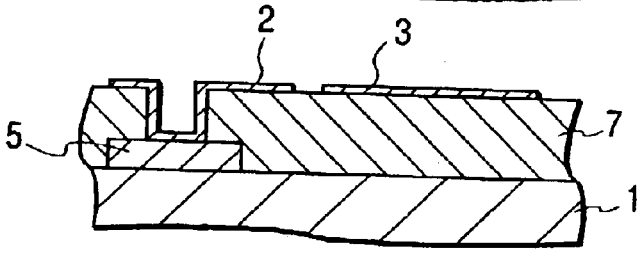

Next, electrodes 2 and 3 shown in FIG. 6D were formed. A resist pattern having openings corresponding to the shapes of the electrodes 2 and 3 was formed by using photoresist (RD-2000N-41, manufactured by Hitachi Kasei Co. Ltd.), and Ti and Ni were deposited in this order to the thicknesses of 5 nm and 100 nm by vacuum evaporation. Next, the resist pattern was removed by using solvent, and the electrodes 2 and 3 having desired patterns were formed through lift-off. The distance between the electrodes 2 and 3 was set to 20 μm.

Process E

Figure 6E:
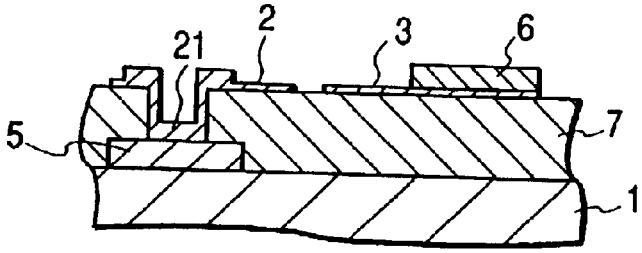

Next, row-directional wires (upper wires) 6 and a pseudo row-directional wire 6' shown in FIG. 6E were formed. Similar to the process D, this process E formed the patterns of the row-directional wires 6 and pseudo row-directional wire 6' by lift-off.

First, similar to the process D, a photoresist pattern was formed, and Ti and Au were deposited in this order to the thicknesses of 5 nm and 500 nm by vacuum evaporation. Next, the resist pattern was removed by using solvent, and the row-directional wires 6 and pseudo row-directional wire 6' having desired shaped were formed by lift-off.

Process F

Figure 6F:
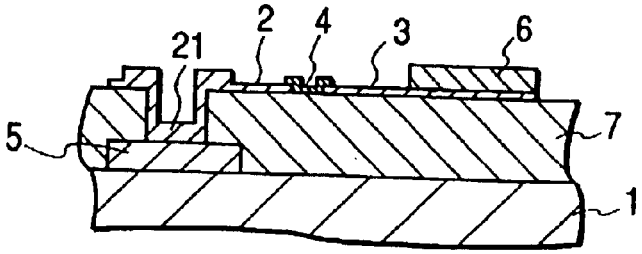

Next, an electroconductive film 4 shown in FIG. 6F was formed. In patterning the electroconductive film 4, lift-off was executed by using a Cr mask pattern. First, a Cr film was deposited to a thickness of 100 nm by vacuum evaporation. Next, by using photoresist and etchant, the Cr film in the area corresponding to the pattern of the electroconductive film 4 was removed and thereafter the photoresist was removed to form the Cr mask.

Next, solution of organic Pd compound (ccp 4230, manufactured by Okuno Pharmaceutical K. K.) was coated by using a spinner and dried. Thereafter, heat treatment is executed for 10 minutes at 300° C. A film having PdO as its main component was therefore formed. Next, the Cr mask was removed by using etchant, and the electroconductive film 4 having a predetermined pattern was formed by removing an unnecessary portion of the PdO film by lift-off. The electroconductive film 4 has a complicated structure having fine particle collections coupled in a mesh shape as microscopically observed. The thickness was about 10 nm and the sheet resistance value was about $5\times10^4$ Ω/□.

Process G

Figure 6G:
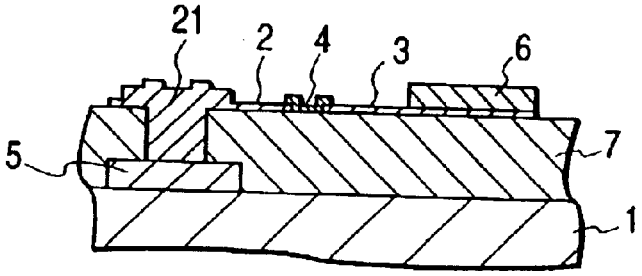

A resist pattern was formed covering the substrate excepting the contact hole 21, and Ti and Au were deposited in this order to the thicknesses of 5 nm and 500 nm by vacuum evaporation. Thereafter, the resist pattern was removed by using solvent to remove an unnecessary portion of the Au/Ti film and fill the contact hole 21 with Au/Ti as shown in FIG. 6G.

Process H

Next, an energization forming operation was executed to form fissures in the electroconductive film 4. The electron source 9 still not completed whose substrate 1 was formed with the column-directional wires 5, pseudo column-directional wire 5', row-directional wires 6, pseudo row-directional wire 6', interlayer insulating films 7, electrodes 2 and 3, and electroconductive films 4, was placed in a vacuum chamber and the inside thereof was evacuated. All the column-directional wires 6 were connected to the ground potential. The row-directional wires 5 were connected via a switching device to a pulse generator in order to apply a desired voltage to each of the row-directional wires 5. A pulse voltage generated by the pulse generator was a rectangular pulse having a pulse width of 1 msec, a pulse interval of 3 msec and a pulse peak value of 11 V. Each time one pulse was applied to one row-directional wire 5, the next adjacent row-directional wire 5 was connected by the switching device to the pulse generator so that all of the 80 row-directional wires 5 was applied with one pulse in 240 msec. The above operations were repeated to apply pulses having a pulse width of 1 msec and a pulse interval of 240 msec to each row-directional wire 5.

The temperature was controlled so that the whole of the electron source 9 took a temperature of about 50° C. At the same time the operation of applying the pulse starts in the above manner, a mixture gas of $H_2$ and $N_2$ was introduced into the vacuum chamber. Immediately thereafter, the value of the resistance between each row-directional wire 5 and the ground potential point increased quickly and the energization forming operation was completed.

Process I

Next, an activation operation was executed. The inside of the vacuum chamber was degassed sufficiently, and the pressure thereof was lowered. Thereafter, benzonitrile was introduced. The amount of benzonitrile introduced was regulated to set the pressure in the chamber to $1.3\times10^{-4}$ Pa.

A pulse voltage was applied to each row-directional wire 5 by the method similar to the process H. However, the pulse voltage was not applied independently to each row-directional wire 5, but one block of ten row-directional wires 5 was applied with the pulse voltage at the same time by the method similar to the process H. After one block was subjected to the activation operation, the activation operation of the next block started. This operation was repeated to complete the activation operation for all the electron-emitting devices.

The pulse voltage used for the activation operation had a pulse width of 1 msec, a pulse interval of 10 msec and a peak value of 16 V as viewed from each row-directional wire 5. With this activation operation, deposits having carbon as their main component were formed on the electroconductive film 4 and the like so that the current (If) flowing through the device increased and electron emission became possible.

Thereafter, the inside of the vacuum chamber was degassed while the vacuum chamber and electron source 9 were heated and maintained at about 300° C. At the same time when this heating starts, the pressure in the chamber rose once and thereafter gradually lowered so that the pressure in the vacuum chamber became sufficiently low. Thereafter, heating was stopped and the vacuum chamber and electron source were gradually cooled to the room temperature.

The anode electrode was disposed facing the electron source 9 in the vacuum chamber. The potential of 1 kV was applied to the anode electrode, a row select voltage was applied to the row-directional wire 5, and a signal voltage was applied to the column-directional wire 6 to emit electrons from a desired electron emitting device. The current flowing through the anode was measured to measure an electron emission current (Ie).

FIRST COMPARATIVE EXAMPLE

An electron source of the first comparative example was manufactured by the method similar to the first embodiment, excepting that the pseudo row-directional wire 5' at X0 and the pseudo column-directional wire 6' at Y0 of the first embodiment were not formed. Measurements similar to the first embodiment were conducted. The measurement results are shown in Table 1.

TABLE 1

| | Ie (Y1) | σy1 | Ie (X1) | σx1 |
|---|---|---|---|---|
| First Embodiment | 1.8 μA | 0.1 μA | 1.8 μA | 0.1 μA |
| First (Comparative Example) Embodiment | 2.1 μA | 0.4 μA | 2.0 μA | 0.5 μA |

The measurement results of the electron source 9 of the first embodiment showed that the 80 devices connected to the Y1 column-directional wire 6 had an average electron emission current Ie of 1.8 μA and a standard deviation of σy1 of 0.1 μA and that the 120 devices connected to the X1 row-directional wire 5 had an average electron emission current Ie of 1.8 μA and a standard deviation of σx1 of 0.1 μA. In contrast, the measurement results of the electron source of the first comparative example showed that the devices connected to the Y1 column-directional wire 6 had an average electron emission current Ie of 2.1 μA and a standard deviation of σy1 of 0.4 μA and that the devices connected to the X1 row-directional wire 5 had an average electron emission current Ie of 2.0 μA and a standard deviation of σx1 of 0.5 μA. As compared to the electron source of the first comparative example, the electron source 9 of the first embodiment had better uniformity of the above-described row-directional wire and column-directional wire.

Devices at other row-directional wires and column-directional wires showed no significant difference from the above-described row-directional wire and column-directional wire.

(Second Embodiment)

In the first embodiment, thin film deposition techniques such as vacuum evaporation and sputtering are used for depositing materials of wires, interlayer insulating films and the like. In the second embodiment, a screen printing method is used for thin film deposition.

The manufacture processes of the second embodiment will be described with reference to FIGS. 7A to 7E. For the simplicity of drawings, although only nine electron emitting devices disposed in a 3×3 matrix shape are shown, the electron source actually manufactured had 720 devices in the row direction and 240 devices in the column direction.

Figure 7A:
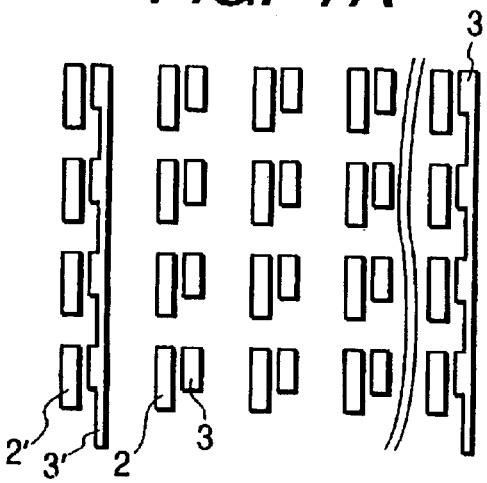
FIGS. 7A, 7B, 7C, 7D and 7E are schematic diagrams illustrating each process of manufacturing the electron source according to a second embodiment of the invention.

First, as shown in FIG. 7A, on a cleaned soda lime glass substrate, electrodes 2 and 3 and pseudo electrodes 2' and 3' were formed. Print paste used was the paste containing organic metal compound which forms metal through thermal decomposition, called "MOD (Metal Organic Deposition) paste. By using this paste, a paste pattern was formed on the substrate by a screen printing method. The metal component of the paste was Au. The paste was dried for 10 minutes at 70° C. by using an electric furnace, thereafter the temperature was raised to 550° C. and maintained for 8 minutes, and then the electric furnace was gradually cooled. The size of the formed pattern was 350 μm×200 μm for the electrode 3 and 500 μm×150 μm for the other electrode 2 (same for the pseudo electrode 2'). The film thickness was about 0.3 μm and the distance between the electrodes 2 and 3 was about 20 μm. The pseudo electrode 3' connected to the Y0 pseudo column-directional wire 6' is an integral single electrode as shown in FIG. 7A. The electrode 3 connected to the Y3 column-directional wire 6 at the position opposite to the Y0 pseudo column-directional wire 6' is also an integral single electrode. As described earlier, the outermost print pattern may have shape defects and may be disconnected. The pseudo column-directional wire 6' and column-directional wire 6 can retain their functions to some degree by forming such integrated single electrodes 3' and 3.

Figure 7B:
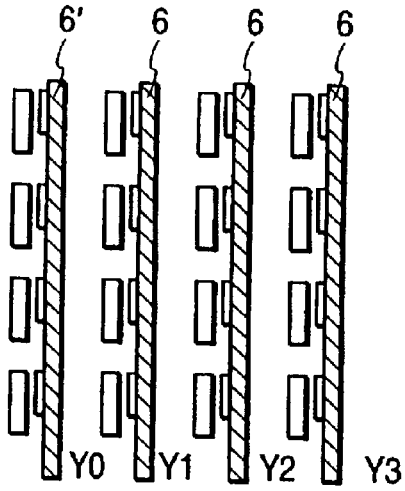

Next, as shown in FIG. 7B, column-directional wires 6 and a pseudo column-directional wire 6' were formed. The paste used was glass binder having lead oxide as its main component and mixed with fine particles of conductive material Ag. After an Ag paste pattern was formed by the screen printing method, it was dried for 20 minutes at 110° C. by using an electric furnace, thereafter the temperature was raised to 550° C. and maintained for 15 minutes, and then the electric furnace was gradually cooled. The width of the formed column-directional wires 6 and pseudo column-directional wire 6' was about 100 μm and the thickness was about 12 μm.

Figure 7C:
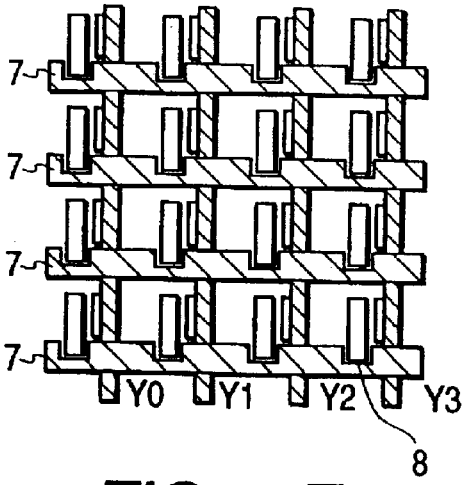

Next, as shown in FIG. 7C, interlayer insulating films 7 were formed. A paste pattern was formed by the screen printing method, the paste being glass paste having PbO as its main component. The paste pattern was dried for 20 minutes at 110° C. by using an electric furnace, thereafter the temperature was raised to 550° C. and maintained for 15 minutes, and then the electric furnace was gradually cooled. The interlayer insulating film 7 having a width of about 500 μm and a thickness of about 30 μm was thus formed.

Figure 7D:
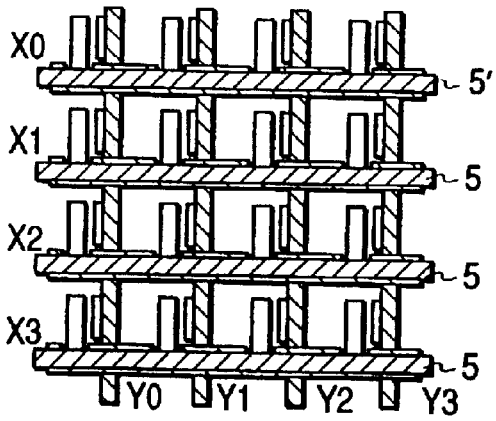

Next, as shown in FIG. 7D, row-directional wires 5 and a pseudo row-directional wire 5' were formed on the interlayer insulating films 7. The row-directional wires 5 and pseudo row-directional wire 5' were formed in the manner similar to the column-directional wires 6 and pseudo column-directional wire 6'.

Figure 7E:
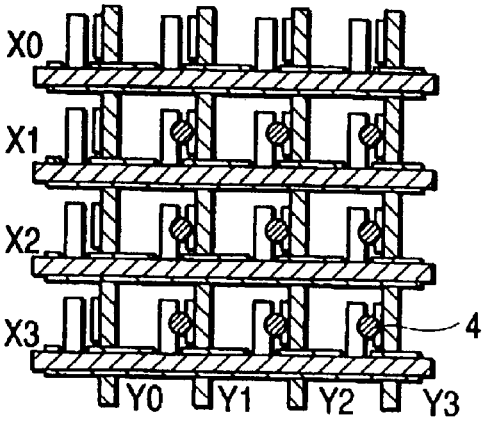

Next, as shown in FIG. 7E, electroconductive films 4 were formed overriding the electrodes 2 and 3. The electroconductive film was not formed for the pseudo electrodes 2' and 3' connected to the pseudo row-directional wire 5' and pseudo column-directional wire 6'.

The electroconductive film 4 was formed by the following method.

First, solution of organic Pd compound was coated in the state of liquid droplet by using an ink jet apparatus, overriding the electrodes 2 and 3. After the liquid drop lets were dried, they were subjected to heat treatment for 10 minutes at 300° C. to form the electroconductive film 4 having PdO as its main component. The electroconductive film 4 had a complicated structure having fine particle collections coupled in a mesh shape as microscopically observed, similar to the first embodiment.

In this embodiment, an image forming apparatus having the structure such as schematically shown in FIG. 3 was manufactured by using the electron source 9. The rear plate 11, face plate 16 and support frame 12 were adhered together by frit glass to constitute a hermetically sealed container 18. In this embodiment, the distance between the electron source 9 and face plate 16 was set to 5 mm. Although not shown, during the manufacture of the image forming apparatus, an air exhaust pipe was coupled to the hermetically sealed container 18 in order to evacuate the inside of the container 18, and at the last manufacture process, the exhaust pipe was sealed and cut off. Also, although not shown, a getter was disposed in the inner peripheral area of the hermetically sealed container 18 to later execute a gettering process by RF heating.

Figure 8:
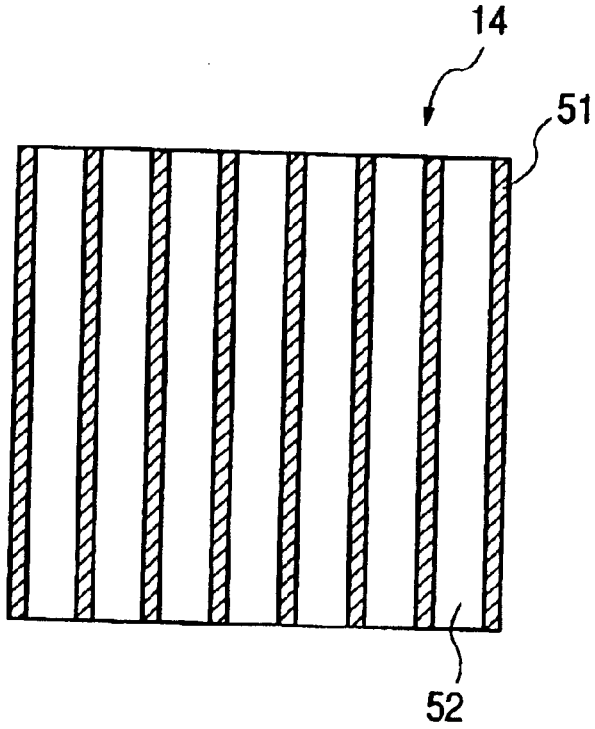
FIG. 8 is a schematic diagram showing the pattern of a fluorescent film.

As shown in FIG. 3, the face plate 16 is made of the glass substrate 13 whose inner surface is formed with the fluorescent film 14 and metal back 15. The fluorescent film 14 is made of florescent members corresponding to three primary colors of red (R), green (G) and blue (B) and black color members 51 separating the fluorescent materials. This embodiment adopted the pattern schematically shown in FIG. 8. Stripes of fluorescent members 52 corresponding to R, G and B are alternately disposed, and the black color member 51 is disposed between the fluorescent members 52. The black member 51 of this pattern is called a "black stripe". The black color member 51 contains black lead as its main component.

Figure 9:
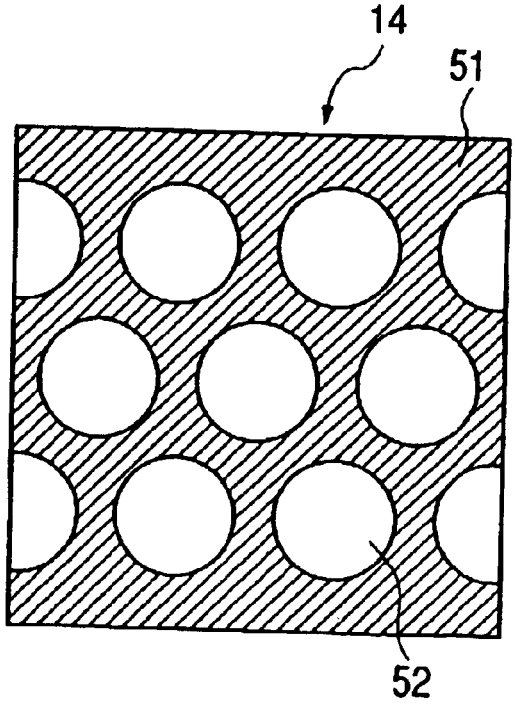
FIG. 9 is a schematic diagram showing the pattern of another fluorescent film.

FIG. 9 shows another pattern of the fluorescent film 14. Dots of fluorescent members 52 are disposed in a triangular lattice shape, and black members 51 are buried between the dots. The black member of this pattern is called a "black matrix".

In this embodiment, the energization forming operation and activation operation described with the first embodiment were executed after the hermetically sealed container 18 was formed. With this method, a vacuum chamber for the operations is not necessary.

After the hermetically sealed container 18 housing therein the electron source 9 was formed, the inside of the container 18 was degassed by an air exhausting apparatus via the air exhaust pipe to set the pressure in the container 18 to about $1.33\times10^{-4}$ Pa. Thereafter, by applying pulse voltages, the energization forming operation was performed. The applied pulse voltage was a triangular pulse voltage having a pulse width of 1 msec, a pulse interval of 10 msec and a peak value of 10 V. The pulse application time was set to 60 seconds.

Next, after the activation operation was performed in the manner similar to the first embodiment, the whole of the hermetically sealed container 18 was heated while the inside of the container 18 was degassed to reduce organic substances, water and the like staying in the container 18. Thereafter, the exhaust pipe was heated to seal and cut it off.

Lastly, the getter was heated by RF heating to perform a gettering process. The getter contains Ba as its main component. As Ba is heated and evaporated, a vapor deposition film is formed on the inner wall of the hermetically sealed container 18. By the absorption function of the vapor deposition film, the pressure in the hermetically sealed container 18 is maintained low.

(Third Embodiment)

Figure 10:
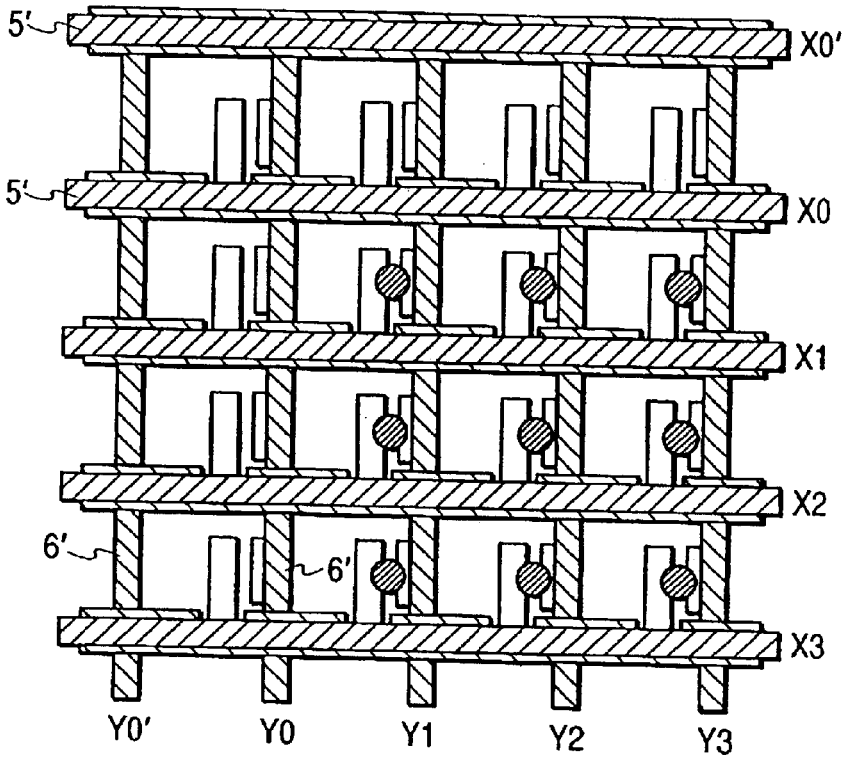
FIG. 10 is a schematic plan view showing the structure of an electron source according to a third embodiment of the invention.

As shown in FIG. 10, an electron source 9 having two pseudo wires in each of the row and column directions was formed, pseudo row-directional wires 5' being formed at positions X0 and X0' and pseudo column-directional wires 6' being formed at positions Y0 and Y0'. Pseudo electrodes to be connected to the X0' pseudo row-directional wire 5' and pseudo column-directional wire 6' were not formed. Pseudo electrodes were not an integral single electrode such as the pseudo electrode 3' of the second embodiment. The other structures were the same as the second embodiment.

SECOND COMPARATIVE EXAMPLE

An electron source was manufactured by the same method as the second and third embodiments, excepting that the pseudo row-directional wire 5', pseudo column-directional wire 6' and pseudo electrodes 2' and 3' were not formed.

A potential of 8 kV was applied to the metal back 15 via its external terminal 17 to emit electrons from the electron source 9 and display an image. The pseudo row-directional wire 5' and pseudo column-directional wire 6' were connected to the ground potential via their external terminals 17.

The electron emission currents Ie of the electron emitting devices connected to the X1 row-directional wire 5 and Y1 column-directional wire 6 were measured by applying an acceleration voltage of 1 kV under the same conditions as the first embodiment. The average values and standard deviations of the luminance of a luminescence point or fluorescent member upon application of electrons from the electron emitting devices of only green (G) were measured by using a pulse having a width of 25 psec and a driving frequency of 60 Hz. The measurement results are shown in Tables 2 and 3. The luminance of the actual image forming apparatus is about ⅕ because of the fluorescent region not applied with electrons and the black stripe region not emitting light.

TABLE 2

| | Ie (Y1) | σy1 | Ie (X1) | σx1 |
|---|---|---|---|---|
| Second Embodiment | 1.7 μA | 0.1 μA | 1.7 μA | 0.1 μA |
| Third Embodiment | 1.6 μA | 0.1 μA | 1.6 μA | 0.1 μA |
| Second Comparative Example | 1.9 μA | 0.35 μA | 2.0 μA | 0.4 μA |

TABLE 3

| | Luminance (Y1) | σy1 | Luminance (X1) | σx1 |
|---|---|---|---|---|
| Second Embodiment | 4000 cd/m$^2$ | 150 cd/m$^2$ | 4100 cd/m$^2$ | 160 cd/m$^2$ |
| Third Embodiment | 3900 cd/m$^2$ | 130 cd/m$^2$ | 3900 cd/m$^3$ | 145 cd/m$^2$ |
| Second Comparative Example | 3700 cd/m$^2$ | 500 cd/m$^2$ | 3800 cd/m$^2$ | 540 cd/m$^2$ |

As shown in Tables 2 and 3, as compared to the second comparative example, the second and third embodiments have good uniformity. The average luminance of the second comparative example is lower than the second and third embodiments. This may be ascribed to that since the distribution of an electric field near the electron emitting device is disturbed, the electron beam shifts from the correct trajectory and the portion of the beam shifted from the beam center and having a slightly lower electron density is applied to the fluorescent member of the fluorescent film.

In the third embodiment, the pseudo electrodes 3' are not structured as the integral single electrode in the column direction. The reason for this is that since the additional pseudo column-directional wire 6' is formed at the Y0' position outside of the Y0 position, there is a low possibility of disconnecting the inner pseudo column-directional wire 6' by print defects and there is no needs for this countermeasure. Also in the third embodiment, the electrodes 3 of the column-directional wire 6 opposite to the pseudo column-directional wire 6' are the integral single pattern similar to the second embodiment. If the pseudo column-directional wire 6' is formed also on this side, the integral single electrode is unnecessary.

This arrangement is more preferable in terms of the uniformity of the electric field. It is also more preferable in the case of the pseudo column-directional wires 6'.

(Fourth and Fifth Embodiments)

In the fourth and fifth embodiments, the pseudo wire is electrically connected to another wire so that the pseudo wire is not necessary to be applied with a potential via the external terminal.

Figure 11:
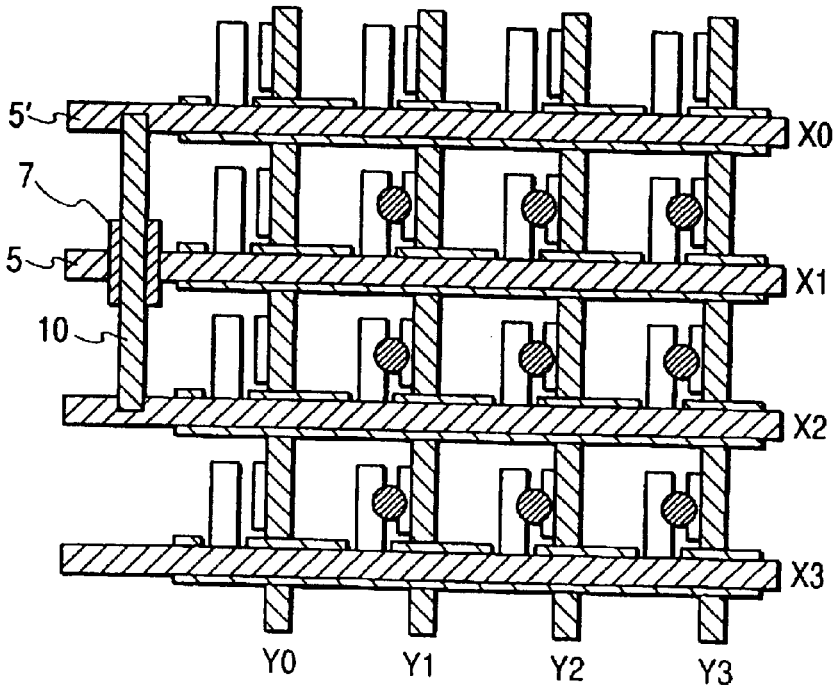
FIG. 11 is a schematic plan view showing the structure of an electron source according to fourth and fifth embodiments of the invention.

In the fourth embodiment, as schematically shown in FIG. 11, a connection wire 10 was formed for interconnecting an X0 pseudo row-directional wire 5 and an X2 row-directional wire 5. The connection wire 10 and an X1 row-directional wire 5 is electrically insulated by an interlayer insulating film 7 formed at their cross point. Although not shown, a Y0 pseudo column-directional wire 6' was connected to a Y1 column-directional wire 6.

In the fifth embodiment, the X0 pseudo row-directional wire is connected to the next adjacent X1 row-directional wire 5.

The other structures are the same as the second embodiment. Similar evaluations described above were conducted and the following results were obtained.

TABLE 4

| | Ie (Y1) | σy1 | Ie (X1) | σx1 |
|---|---|---|---|---|
| Fourth Embodiment | 1.7 μA | 0.1 μA | 1.7 μA | 0.1 μA |
| Fifth Embodiment | 1.7 μA | 0.1 μA | 1.8 μA | 0.11 μA |

TABLE 5

| | Luminance (Y1) | σy1 | Luminance (X1) | σx1 |
|---|---|---|---|---|
| Fourth Embodiment | 4000 cd/m$^2$ | 150 cd/m$^2$ | 4100 cd/m$^2$ | 160 cd/m$^2$ |
| Fifth Embodiment | 4100 cd/m$^2$ | 160 cd/m$^2$ | 4300 cd/m$^2$ | 200 cd/m$^2$ |

The electron emission current Ie and luminance of the electron emitting device connected to the X1 row-directional wire 5 of the fifth embodiment were slightly higher than the electron emitting devices connected to the other column-directional wires. This may be ascribed to the following. With the driving method of the embodiments, a row select voltage is applied to the row-directional wire 5, and a signal voltage is applied to the column-directional wire 6. Therefore, while electrons are emitted from the electron emitting device electrically connected to the X2 row-directional wire 5, the potential of the pseudo row-directional wire 5' takes the value same as that of the X2 row-directional wire 5. While electrons are emitted from the electron emitting device connected to the other row, the row-directional wire wires 5 on both sides of the other row take the ground potential. In this manner, the conditions of only the electron emitting device electrically connected to the X1 row-directional wire 5 are different from the conditions of other rows.

In the embodiments, the effect of the row-directional wire 5 connected to the pseudo row-directional wire 5' was checked. A similar phenomenon is expected also for the connection between the pseudo column-directional wire 6' and column-directional wire 6.

(Sixth Embodiment)

In this embodiment, a number of pseudo row-directional wires 5' and pseudo column-directional wires 6' are formed.

Figure 12:
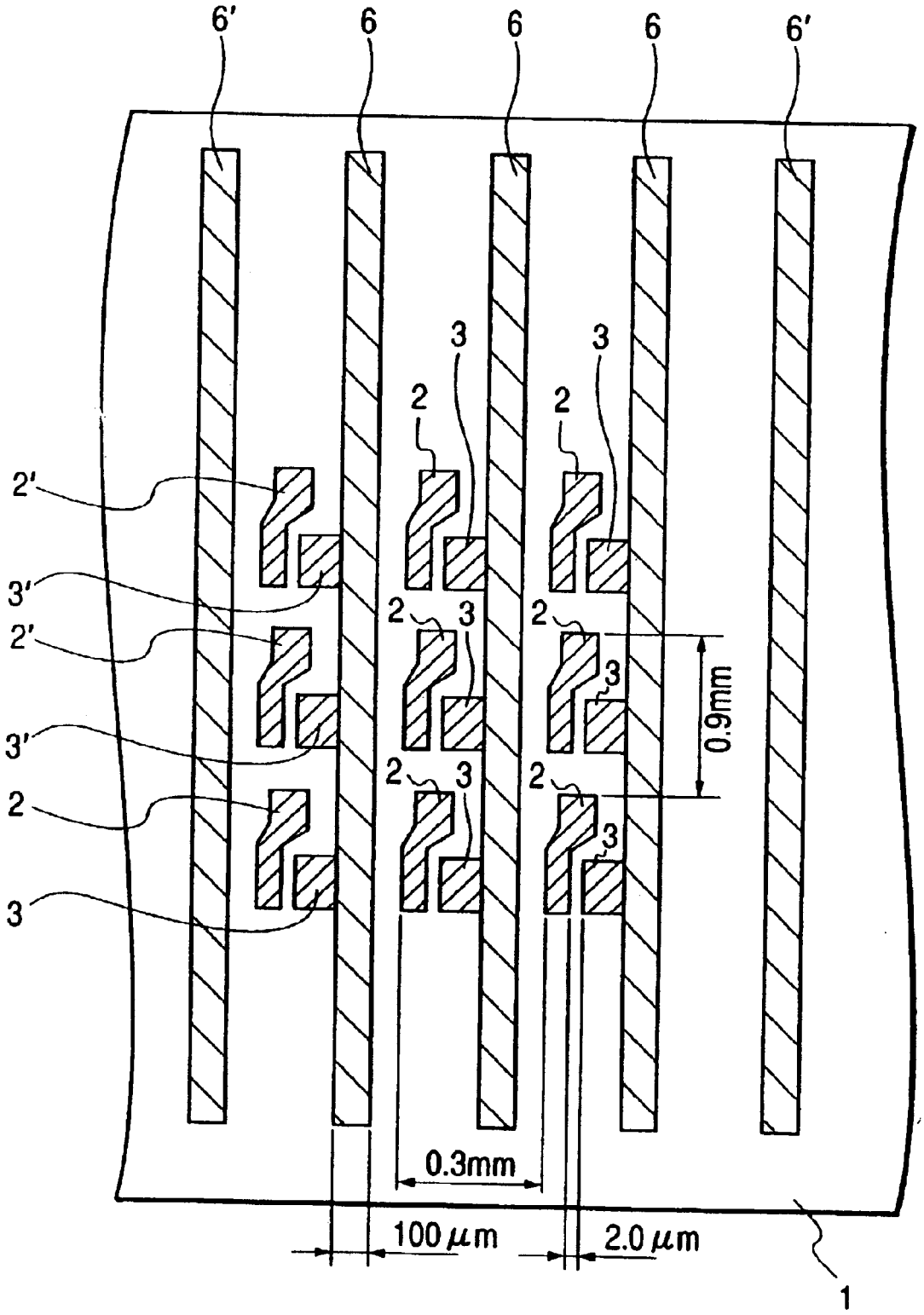
FIG. 12 is a schematic diagram showing the structure of column-directional wires and pseudo column-directional wires of an electron source according to a sixth embodiment of the invention.
Figure 13:
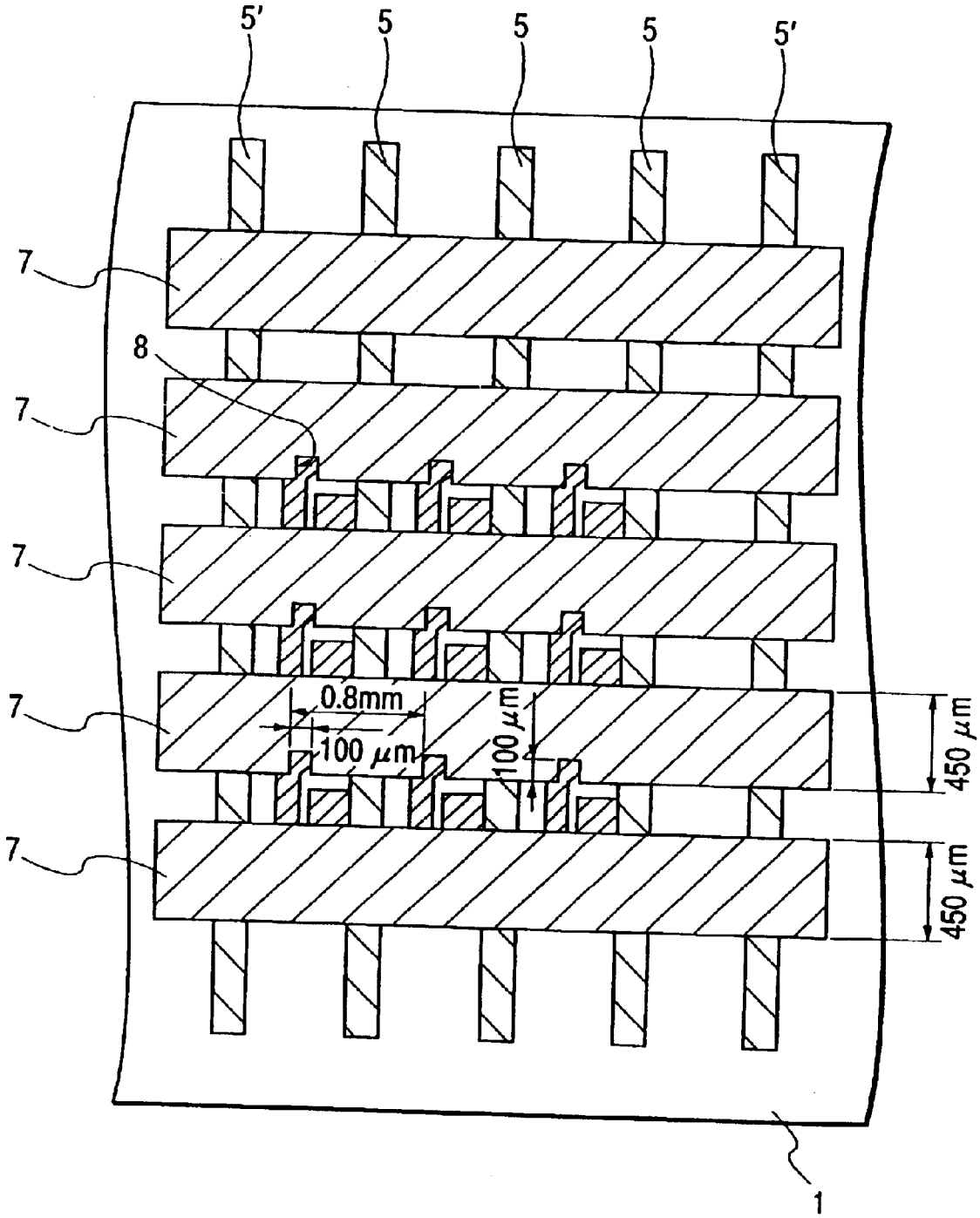
FIG. 13 is a schematic diagram showing the structure of interlayer insulating films of the electron source according to the sixth embodiment of the invention.
Figure 14:
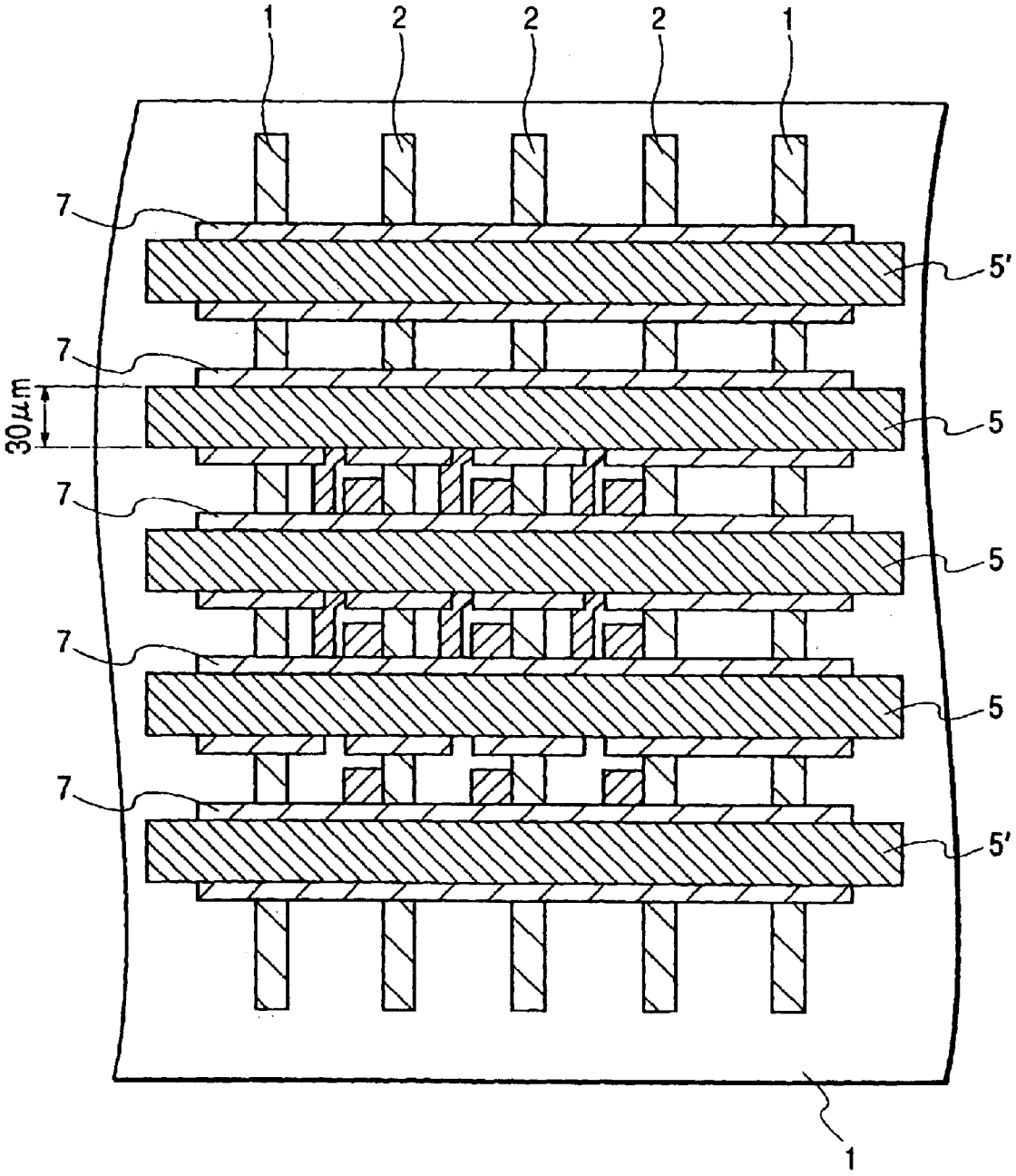
FIG. 14 is a schematic diagram showing the structure of column-directional wires and pseudo column-directional wires of the electron source according to the sixth embodiment of the invention.
Figure 15:
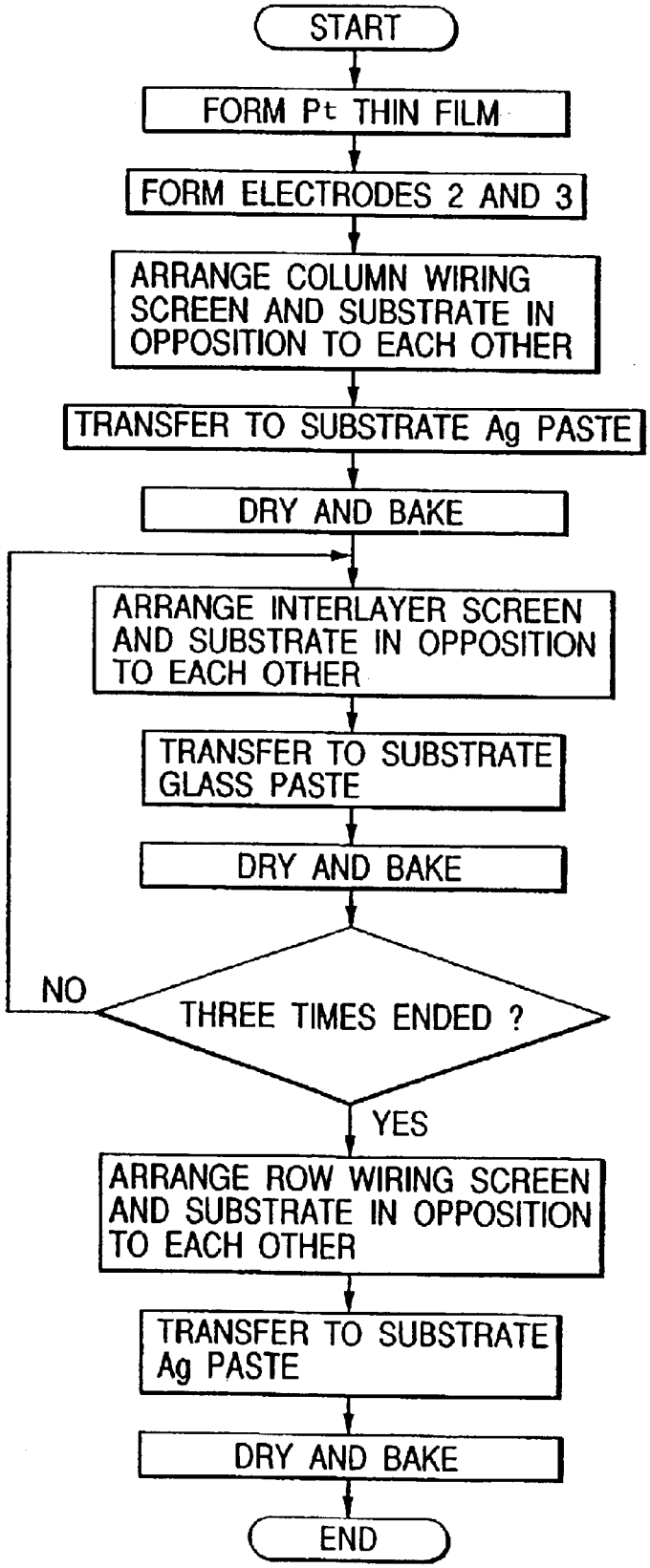
FIG. 15 is a flow chart illustrating each process of manufacturing the electron source according to the sixth embodiment of the invention.

Manufacture processes of this embodiment will be described with reference to FIGS. 12 to 14 showing partial schematic plan views of an electron source at each manufacture process and with reference to the flow chart of FIG. 15 illustrating the manufacture processes.

First, on a soda lime glass substrate, a Pt film is formed by sputtering, and an unnecessary Pt film is removed by photolithography and dry etching to form electrodes 2 and 3 made of Pt. For the simplicity of drawings, although only those electrodes corresponding to nine electron emitting devices are shown, electron devices are actually disposed in a 480×1920 matrix shape.

The distance between the electrodes 2 and 3 was set to 20 μm, the pitch of them in the column direction was set to 0.9 mm and the pitch in the row direction was set to 0.3 mm. Next, column-directional wires 6 and pseudo column-directional wires 6' were formed by the screen printing method. In FIG. 12, although the pseudo column-directional wire 6' are shown on both side of the column-directional wires 6, ten pseudo column-directional wires were actually formed on both sides of the column-directional wires 6.

Figure 16:
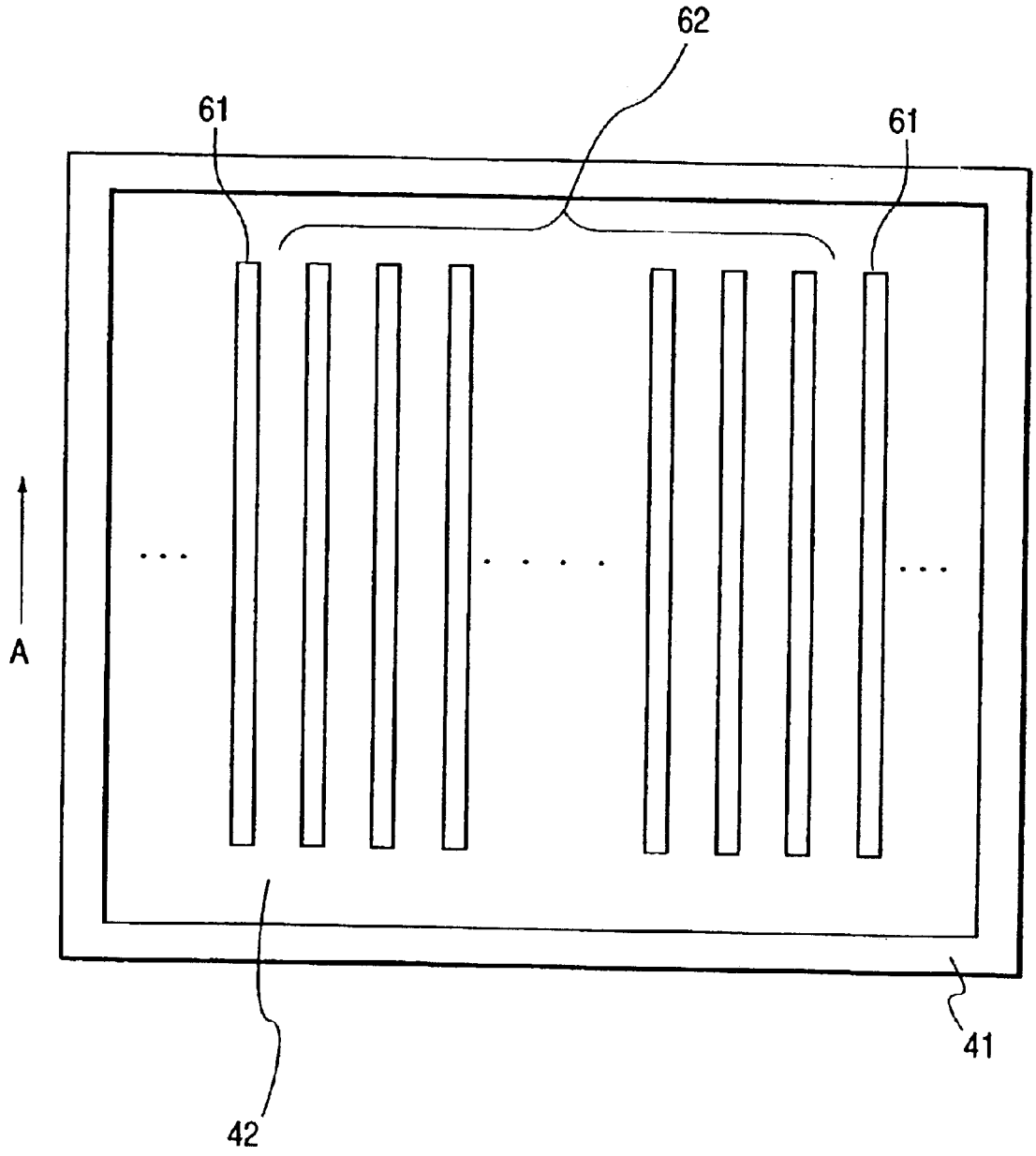
FIG. 16 is a schematic plan view of a screen impression for column-directional wires and pseudo column-directional wires.

Paste containing Ag was used for the printing. A screen impression schematically shown in FIG. 16 was used which was made of a mesh combination screen impression of SUS 400 with pseudo column-directional wires 61 and column-directional wires 62 being formed thereon. By using this screen impression, Ag paste patterns were formed. Thereafter, the patterns were dried at a temperature of 100° C. and thereafter the temperature was raised to 530° C. at which a heat treatment was performed to form the column-directional wire wires 6 and pseudo column-directional wires 6' such as shown in FIG. 12.

Figure 17:
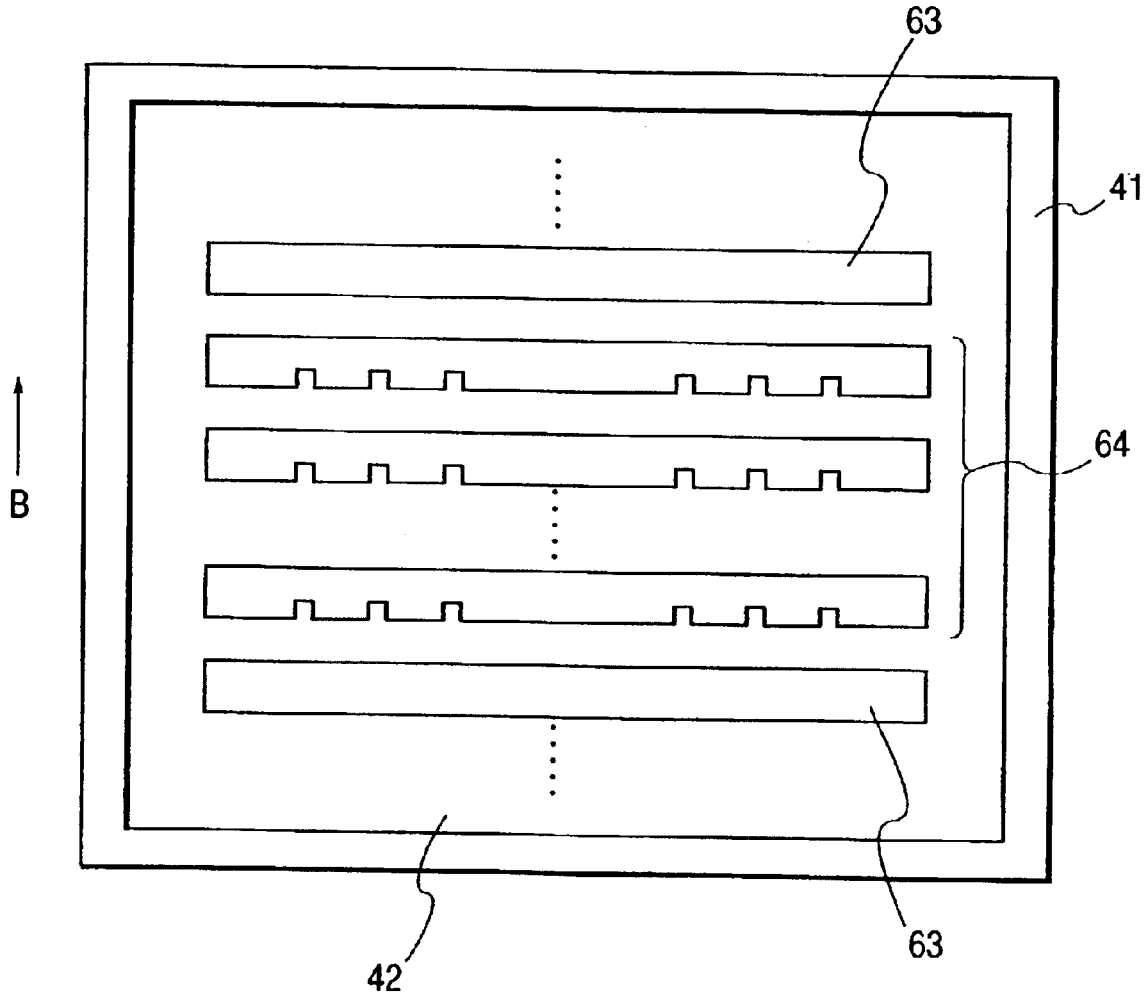
FIG. 17 is a schematic plan view of a screen impression for interlayer insulating films.

Next, interlayer insulating films 7 were formed by using glass paste and a screen impression made of a mesh combination screen impression of SUS 300. This screen impression had patterns such as shown in FIG. 17 for forming interlayer insulating film patterns 63 and comb-shaped interlayer insulating film patterns 64 for forming interlayer insulating film 6 with recesses 8. As shown in FIG. 13, the pattern of the interlayer insulating film 7 had recesses 8 in the areas corresponding to the electrodes so that the electrodes were not covered with the interlayer insulating film 7. After the patterns were formed, they were dried at 100° C., and thereafter the temperature was raised to 530° C. to execute a heat treatment. These operations were repeated three times. The interlayer insulating film 7 having a sufficient thickness and without any dielectric defect such as pin holes was able to be formed.

Figure 18:
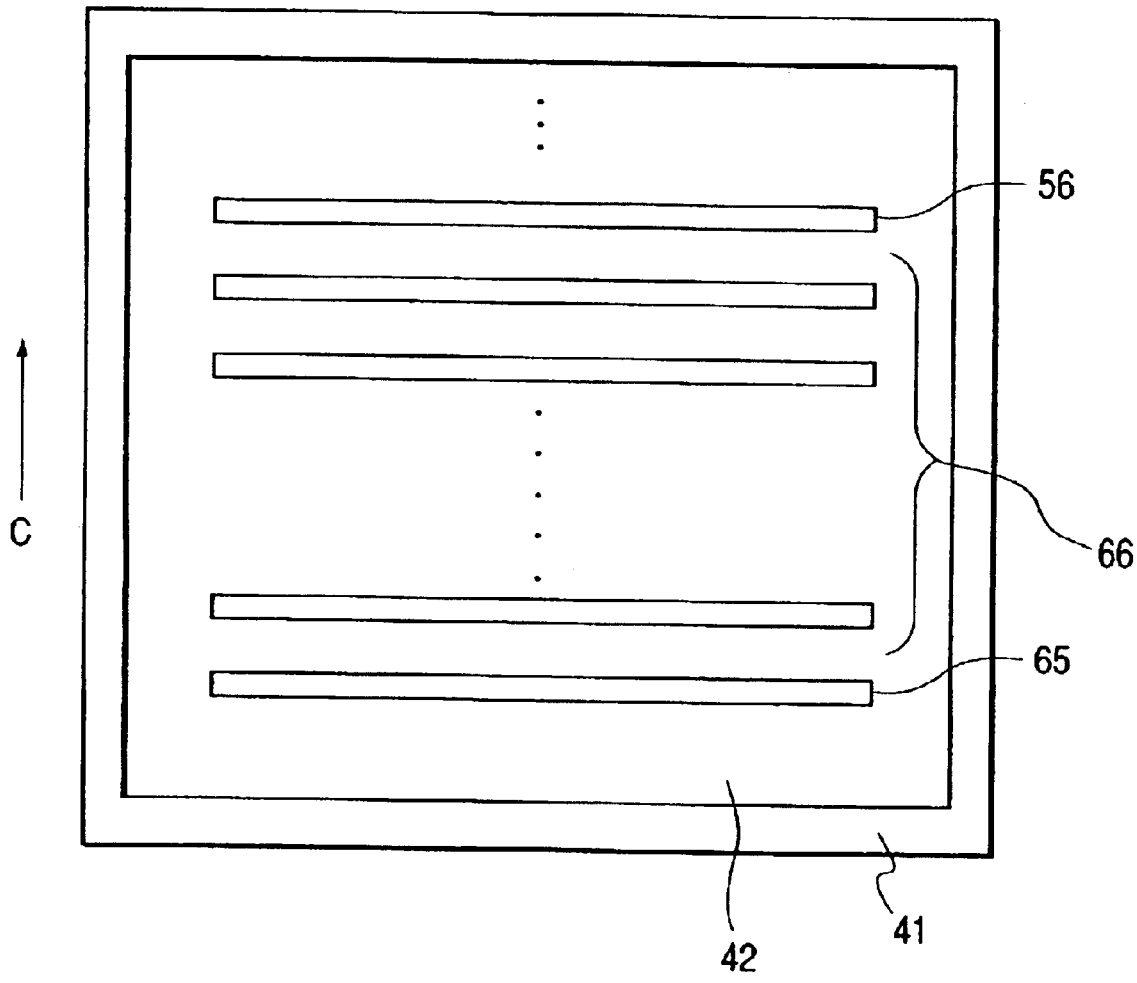
FIG. 18 is a schematic plan view of a screen impression for row-directional wires and pseudo row-directional wires.
Figure 19:
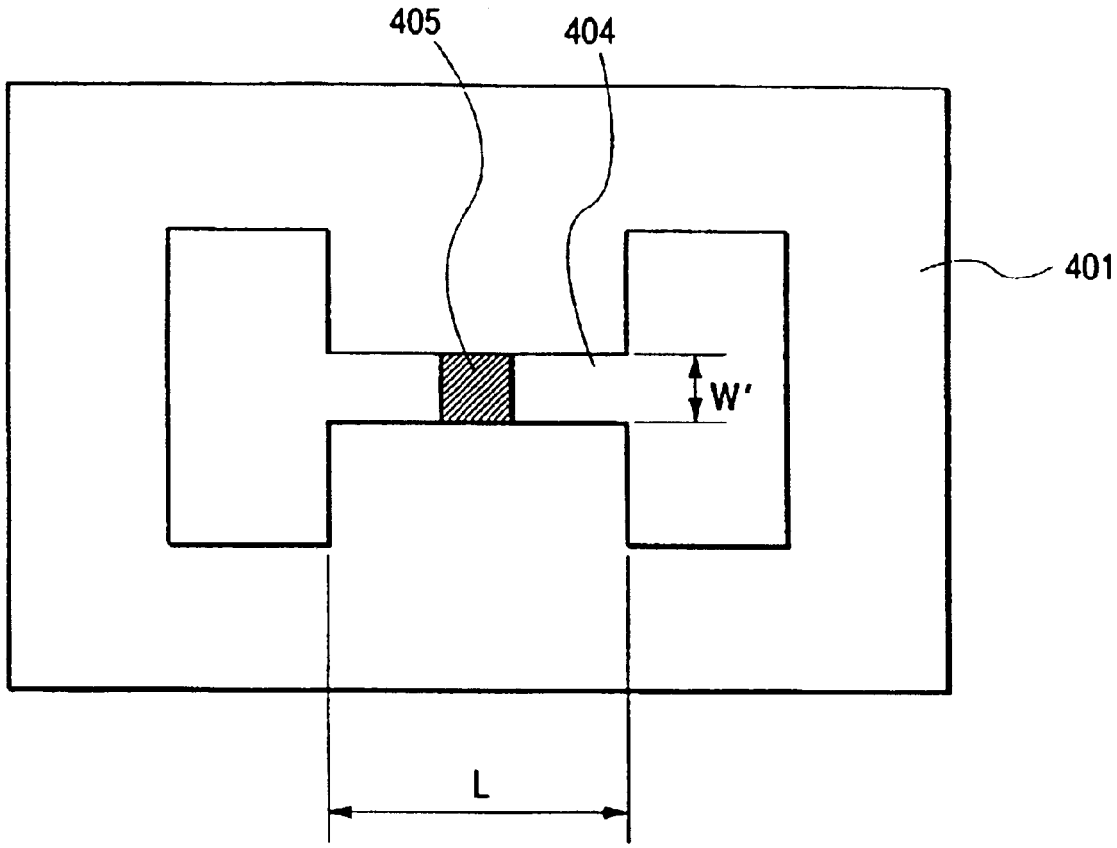
FIG. 19 PRIOR ART
FIG. 19 is a schematic diagram showing an example of a conventional surface conduction electron emitting device.
Figure 20:
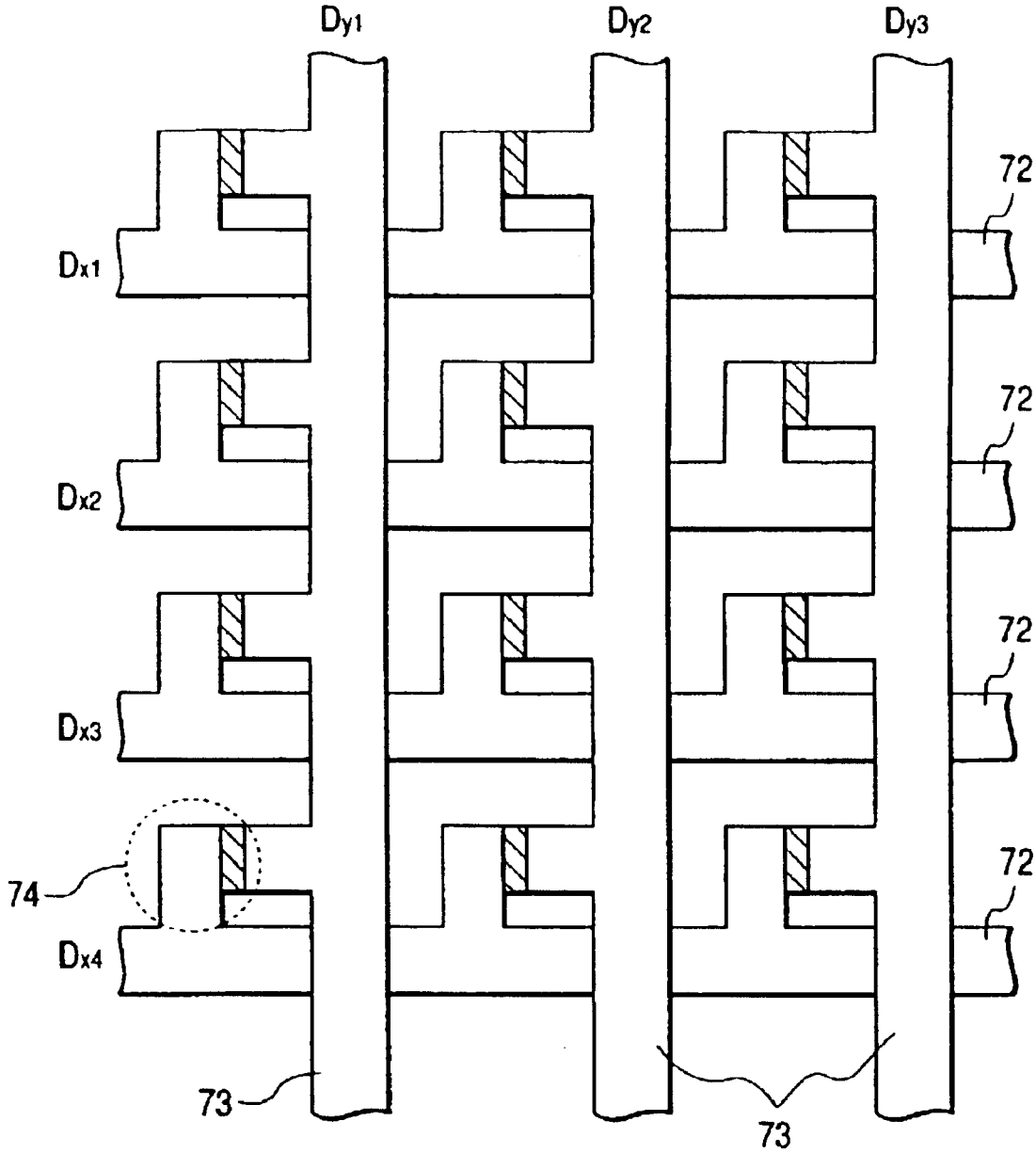
FIG. 20 PRIOR ART
FIG. 20 is a schematic diagram showing an example of a wiring pattern of a conventional electron source.
Figure 21A:
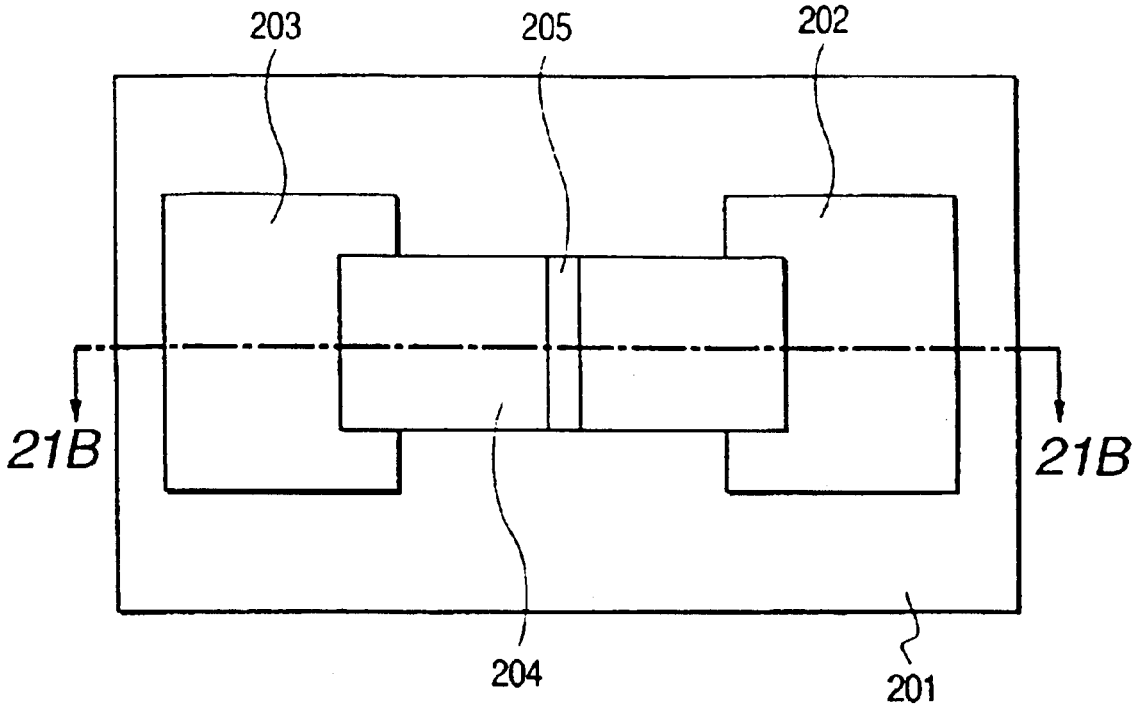
FIG. 21A PRIOR ART
FIGS. 21A and 21B are schematic diagrams showing an example of another conventional surface conduction electron emitting device.
Figure 21B:
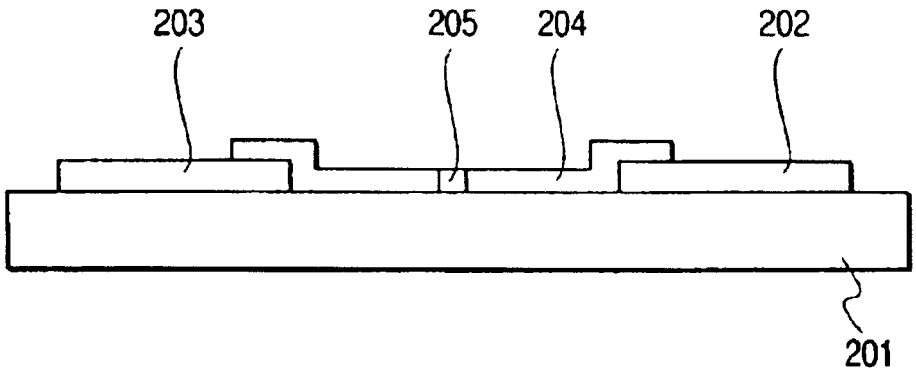
FIG. 21B PRIOR ART
Figure 22:
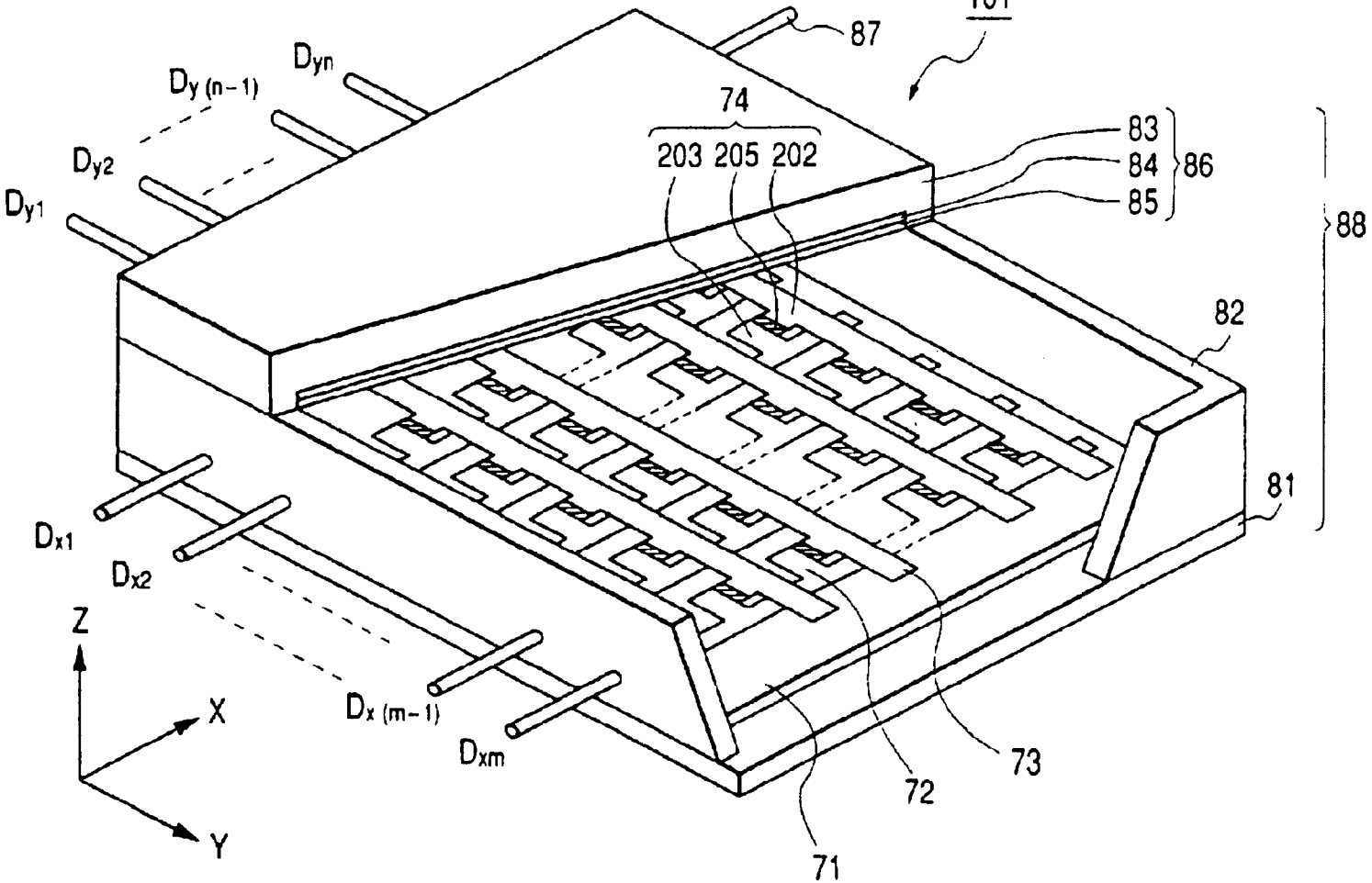
FIG. 22 PRIOR ART
FIG. 22 is a perspective view schematically showing an example of the structure of a conventional image forming apparatus.
Figure 23:
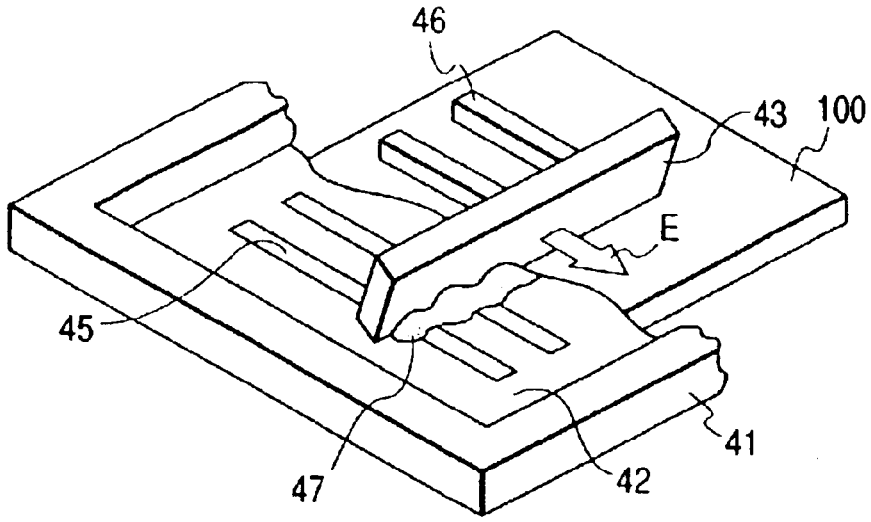
FIG. 23 PRIOR ART
FIG. 23 is a partially broken perspective view of a conventional screen mesh and a substrate.
Figure 24:
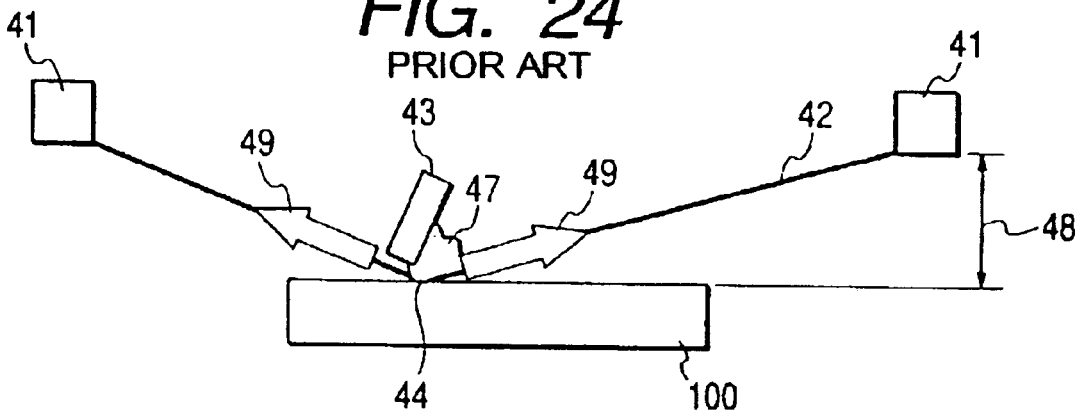
FIG. 24 PRIOR ART
FIG. 24 is a side view of the conventional screen mesh and the substrate.
Figure 25:
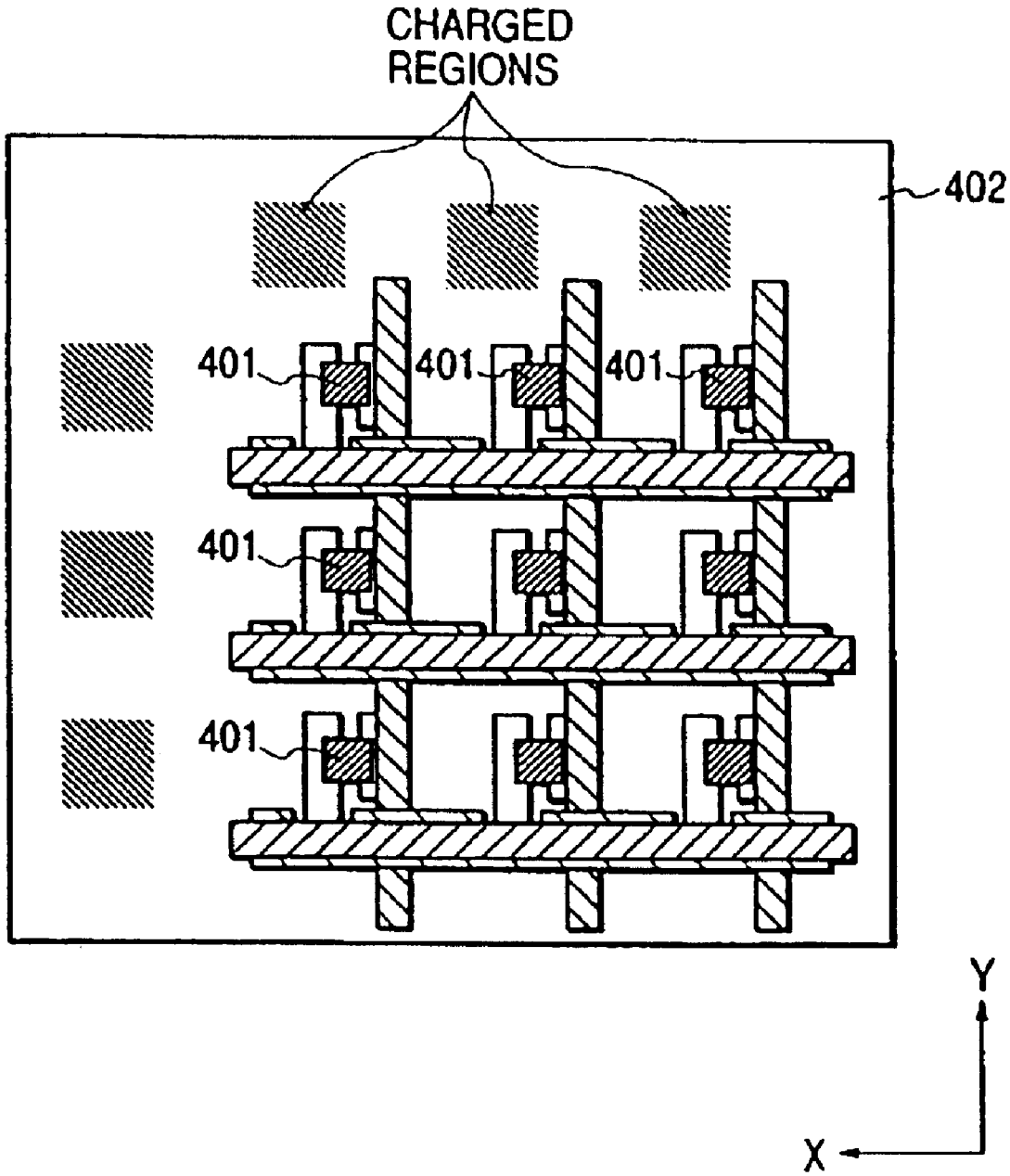
FIG. 25 PRIOR ART
FIG. 25 is a schematic diagram showing charged areas formed on a conventional substrate.

Next, by using Ag paste and a screen impression schematically shown in FIG. 18 made of a mesh combination screen of SUS 300 and having pseudo row-directional wire patterns 65 and row-directional wire patterns 66, row-directional wires 5 and pseudo row-directional wires 5' were formed on the interlayer insulating films 7 as shown in FIG. 14 by the screen printing method. Ten pseudo row-directional wires 5' were actually formed on both sides of the row-directional wires 5.

As above, at the same time when the row-directional wires 5 and column-directional wires 6 to be used as real wires were formed, the pseudo row-directional wires 5' and pseudo column-directional wires 6' not to be used as real wires were formed on respective sides of the outermost row-directional wires 5 and column-directional wires 6 nearest to the periphery of the substrate 1. Therefore, pattern defects were able to be suppressed.

The manufacture processes to follow are similar to the second embodiment, and so the detailed description thereof is omitted.

As described so far, according to the invention, since first and second conductors are formed on the substrate, it is possible to suppress charged areas having a large charge amount from being formed near the periphery of the substrate. Accordingly, it is possible to improve uniformity of the electron emission characteristics of electron emitting devices. Furthermore, at the same time when first and second wires are formed by the screen printing method, the first and second conductors are formed. Accordingly, all the first and second conductors on the substrate can be formed uniformly. It is therefore possible to improve uniformity of the electron emission characteristics of electron emitting devices.

What is claimed is:

1. An electron source comprising:

a plurality of first conductors disposed at predetermined intervals on a substrate;

a plurality of second conductors disposed at predetermined intervals on the substrate, wherein said second conductors intersect said first conductors so that said first and second conductors constitute a matrix conductor;

a plurality of electron emitting devices disposed in a matrix on the substrate, wherein each of said electron emitting devices is connected to one of said first conductors and to one of said second conductors;

a third conductor disposed along a direction in which said first conductors extend along the substrate, said third conductor positioned between said electron emitting devices which are outermost in the matrix and an outer periphery of the substrate, at a side opposite to a side where at least one of said first conductors connected to at least one outermost electron emitting device is disposed, wherein said third conductor is not connected to at least one of said electron emitting devices connected to said second conductors; and a fourth conductor disposed along a direction in which said second conductors extend along the substrate, said fourth conductor positioned between said electron emitting devices which are outermost in the matrix and an outer periphery of the substrate, at a side opposite to a side where at least one of said second conductors connected to at least one outermost electron emitting device is disposed, wherein said fourth conductor is not connected to at least one of said electron emitting devices connected to said first conductors.

2. The electron source according to claim 1, wherein an interval disposed between said third conductor and one of said first conductors that is most adjacent to said third conductor, is less than twice as long as another interval disposed between most-adjacent ones of said first conductors.

3. The electron source according to claim 1, wherein an interval disposed between said fourth conductor and one of said second conductors that is most adjacent to said fourth conductor, is at least twice as long as another interval disposed between most-adjacent ones of said second conductors.

4. The electron source according to claim 1, wherein an interval disposed between said fourth conductor and one of said second conductors that is most adjacent to said fourth conductor, is less than twice as long as another interval disposed between most-adjacent ones of said second conductors.

5. The electron source according to claim 1, wherein said third conductor intersects said fourth conductor, sandwiching an insulating layer therebetween.

6. An electron source comprising:

a plurality of first conductors disposed at predetermined intervals on a substrate;

a plurality of second conductors disposed at predetermined intervals on the substrate, wherein said second conductors intersect said first conductors so that said first and second conductors constitute a matrix conductor;

a plurality of electron emitting devices disposed in a matrix on the substrate, wherein each of said electron emitting devices is connected to a corresponding one of said first conductors and to a corresponding one of said second conductors;

a third conductor disposed along a direction in which said first conductors extend along the substrate, said third conductor positioned between those ones of said electron emitting devices which are outermost in the matrix and an outer periphery of use substrate; and a fourth conductor disposed along a direction in which said second conductors extended along the substrate, said fourth conductor positioned between those ones of said electrons emitting devices which are outermost in the matrix and the outer periphery of the substrate, at a side opposite to a side where at least one of said second conductors connected to at least one outermost electrons emitting device is disposed, wherein said fourth conductor is not connected to at least one of said electron emitting devices connected to said first conductors, and said third conductor intersects said fourth conductor and sandwiches an insulator therebetween.

* * * * *

UNITED STATES PATENT AND TRADEMARK OFFICE

CERTIFICATE OF CORRECTION

PATENT NO. : 6,794,813 B2
DATED : September 21, 2004
INVENTOR(S) : Takeo Ono et al.

It is certified that error appears in the above-identified patent and that said Letters Patent is hereby corrected as shown below:

Title page,
Item [75], Inventors, "Takeo Ono, Kanagawa-Ken (JP); Toru Sugeno, Kanagawa-Ken (JP)" should read -- Takeo Ono, Sagamihara (JP); Toru Sugeno, Kawasaki (JP) --.
Item [56], References Cited, FOREIGN PATENT DOCUMENTS, "09/027270" should read -- 09-027270--; and "JP 9-272270 1/1997" should be deleted.
OTHER PUBLICATIONS,
"C.A. Spindt" reference, "*Molybd num*" should read -- *Molybdenum* --.
"H. Araki, et a;., "*Electorforming and Electron Emission of Carbon Thin Films*, Journal of th" should read -- H. Araki, et al., *Electroforming and Electron Emission of Carbon Thin Films*, Journal of the --.
Item [57], ABSTRACT,
Line 11, "and are" should read -- are --.

Column 1,
Line 41, "Advance" should read -- Advances --.
Line 43, "molybdenium" should read -- molybdenum --.
Line 49, "Recio" should read -- Radio --.

Column 3,
Line 15, "Constance," should read -- constant, --.

Column 4,
Line 16, "is" should read -- are --.

Column 5,
Line 12, "becomes" should read -- comes --.

Column 7,
Line 54, "least" should read -- least to --.
Line 65, "effectively" should read -- effectively be --.

Column 9,
Line 13, "also" should read -- also the. --.
Line 14, "belongs" should read -- belong --.

Column 13,
Line 31, "wire" (both occurrences) should read -- wires --.
Line 38, "wire" should read -- wires --.

UNITED STATES PATENT AND TRADEMARK OFFICE

CERTIFICATE OF CORRECTION

PATENT NO. : 6,794,813 B2
DATED : September 21, 2004
INVENTOR(S) : Takeo Ono et al.

It is certified that error appears in the above-identified patent and that said Letters Patent is hereby corrected as shown below:

Column 15,
Line 20, "shown" should read -- show --.

Column 16,
Line 67, "FIG. 4," should read -- FIG. 4. --.

Column 21,
Line 1, "droplets" should read -- droplets --.

Column 22,
Line 31, "psec" should read -- $\mu$sec --.
Line 56, "cd/m$^3$" should read -- cd/m$^2$ --.

Column 23,
Line 10, "needs" should read -- need --.

Column 24,
Line 36, "side" should read -- sides --.

Column 26,
Line 44, "use" should read -- the --.
Line 52, "trons" should read -- tron --.

Signed and Sealed this

Twenty-third Day of August, 2005

JON W. DUDAS
*Director of the United States Patent and Trademark Office*